US005216768A

United States Patent [19]

Bodine et al.

[11] Patent Number: 5,216,768

[45] Date of Patent: Jun. 8, 1993

[54] BED SYSTEM

[75] Inventors: Oliver H. Bodine, Garrison; Jack Wilkerson, Pleasant Valley, both of N.Y.

[73] Assignee: Oliver H. Bodine, Jr., Garrison, N.Y.

[21] Appl. No.: 634,936

[22] Filed: Dec. 27, 1990

Related U.S. Application Data

[63] Continuation of Ser. No. 364,565, Jun. 5, 1989, abandoned, which is a continuation-in-part of Ser. No. 272,625, Nov. 17, 1988, abandoned.

[51] Int. Cl.[5] ..... A47C 27/08; A47C 27/10

[52] U.S. Cl. ..... 5/453; 5/428; 5/430; 5/449; 5/903; 5/914

[58] Field of Search ..... 5/453, 455, 449, 460, 5/471, 499, 428, 430, 457, 914, 903; 251/7, 8

[56] References Cited

U.S. PATENT DOCUMENTS

| | | | |
|---|---|---|---|
| 49,538 | 8/1865 | Matthews | 251/7 X |
| 1,034,800 | 8/1912 | Hunt | 5/499 |
| 1,562,809 | 11/1925 | Thompson | 5/499 X |
| 1,963,739 | 6/1934 | Engel | 5/499 X |
| 2,817,854 | 12/1957 | Pratt | 5/428 |
| 2,817,855 | 12/1957 | Pratt | 5/430 |

(List continued on next page.)

FOREIGN PATENT DOCUMENTS

| | | | |
|---|---|---|---|
| 949652 | 2/1964 | United Kingdom | 5/455 |
| 1263369 | 2/1972 | United Kingdom | 5/499 |
| 1545806 | 5/1979 | United Kingdom | 5/455 |

OTHER PUBLICATIONS

Brochure by Air Plus, Inc., Houston, Tex.

Brochures by Mediscus, Dorset, England.

"The effectiveness of air flotation beds", from *Care Science and Practice* Dec. 1984.

Materials on Grant air pad, Grant, Stamford, Conn.

Materials on Gaymar air pad, Gaymar Industries, USA, 1986–1987.

"The Role of Alternating Pressure in Prevention of Pressure Sores" by Lawrence H. Bernstein, M.D., University of Connecticut School of Medicine.

*Primary Examiner*—Renee S. Luebke
*Assistant Examiner*—Michael J. Milano
*Attorney, Agent, or Firm*—John H. Crozier

[57] ABSTRACT

In one aspect of the invention, a bed structure having a mattress deck panel and side panels, with internal reinforcing bulkheads and single-piece head- and footboards serving as reinforcing bulkheads at the head and foot of the structure. In another aspect of the invention, there is provided a low-cost air bed employing the above structure. In an additional aspect of the invention, there is provided an air bed which incorporates the air supply and control components within the bed structure itself. In a further aspect of the invention, there is provided a low-noise air flow control pinch valve. In yet another aspect of the invention, there is provided a single air bag which simulates multiple air bags through the use of welded internal baffles. In yet an additional aspect of the invention, there is provided a bed siderail which is patient-operable. In yet a further aspect of the invention, there is provided a device having the features of an air bed, which device is highly portable and which can be shipped by conventional mail or by parcel delivery services.

39 Claims, 15 Drawing Sheets

U.S. PATENT DOCUMENTS

| | | | |
|---|---|---|---|
| 3,170,172 | 2/1965 | Kessman | 5/457 |
| 3,585,659 | 6/1971 | Burst et al. | 5/430 |
| 3,626,497 | 12/1971 | Lambert | 251/8 |
| 3,790,975 | 2/1974 | Philipp et al. | 5/457 |
| 3,822,425 | 7/1974 | Scales | 5/348 R |
| 3,848,282 | 11/1974 | Viesturs | 5/457 X |
| 3,879,776 | 4/1975 | Solen | 5/350 |
| 3,909,858 | 10/1975 | Ducker | 5/348 R |
| 3,913,153 | 10/1975 | Adams et al. | 5/68 |
| 3,914,811 | 10/1975 | Francis | 5/457 X |
| 4,044,286 | 8/1977 | Adams et al. | 318/297 |
| 4,099,276 | 7/1978 | Hunt et al. | 5/455 X |
| 4,149,285 | 4/1979 | Stanton | 5/454 |
| 4,163,297 | 8/1979 | Neumark | 5/455 X |
| 4,267,611 | 5/1981 | Agulnick | 5/455 X |
| 4,297,755 | 11/1981 | Mollura | 5/455 |
| 4,326,695 | 4/1982 | Lincoln | 251/7 |
| 4,346,489 | 8/1982 | McMullan | 5/451 |
| 4,454,615 | 6/1984 | Whitney | 5/449 |
| 4,488,322 | 12/1984 | Hunt et al. | 5/453 |
| 4,525,885 | 7/1985 | Hunt et al. | 5/455 X |
| 4,542,547 | 9/1985 | Sato | 5/453 |
| 4,594,743 | 6/1986 | Owen et al. | 5/457 X |
| 4,617,689 | 10/1986 | Nelson et al. | 5/400 |
| 4,617,690 | 10/1986 | Grebe | 5/453 |
| 4,624,877 | 11/1986 | Lea et al. | 5/449 X |
| 4,644,597 | 2/1987 | Walker | 5/449 |
| 4,653,131 | 3/1987 | Diehl | 5/497 |
| 4,662,012 | 5/1987 | Torbet | 5/455 X |
| 4,686,722 | 8/1987 | Swart | 5/453 |
| 4,768,249 | 9/1988 | Goodwin | 5/455 X |
| 4,787,406 | 11/1988 | Edwards et al. | 251/8 X |
| 4,825,486 | 5/1989 | Kimura et al. | 5/455 X |
| 4,833,457 | 5/1989 | Graebe, Jr. | 5/455 X |
| 4,944,060 | 7/1990 | Peery et al. | 5/455 X |
| 4,949,414 | 8/1990 | Thomas et al. | 5/455 X |

BED SYSTEM

This is a continuation of co-pending application Ser. No. 07/364,565 filed on Jun. 5, 1989, now abandoned, which was a continuation-in-part of Ser. No. 07/272,625, filed on Nov. 17, 1988, abandoned.

BACKGROUND OF THE INVENTION

1. Field of the Invention.

The present invention relates to beds generally and, more particularly, to a novel bed structure especially suited for low air loss air beds and being exceptionally economical to manufacture and use.

2. Background Art.

While the present invention and particular features thereof are described for illustrative purposes as being applied, in one embodiment, to low loss air beds, it will be understood that the various aspects of the invention have applications in other types of beds, as well as in non-bed applications, and all such applications are within the intent of the present invention.

A major problem in health care facilities is with bed-bound patients who cannot turn or roll over without assistance. Failure to roll over relatively frequently causes restriction of blood flow in the area of bony protuberances on a patient's body which, in turn, causes ulcerated bed, or pressure, sores. Such sores are extremely long-healing and, with a chronically or terminally ill patient, frequently recur. According to hospital industry standards, it has been estimated that to cure a single bed sore costs society an average $40,000 and many patients die from bed sores. A standard procedure is to have nursing personnel turn each immobile patient every two hours. This is not entirely unsatisfactory in a hospital setting where nursing staff is continually available, but may be an unsatisfactory procedure in institutions, such as nursing homes, or in private homes where such assistance may not be available on a frequent basis. One conventional technique for avoiding bed sores is to have the patient repose in a plaster of Paris bed in which the plaster of Paris has set to the patients contours. Although providing a hard surface, there is sufficient surface area that the pressure on the patient's body remains below the body's capillary pressure.

A recent development to address the problem of bed sores is the so-called "low loss air bed". This type of bed comprises a fairly typical hospital bed which has, instead of a standard mattress, a plurality of air bags disposed perpendicularly to the axis of the bed from its head to its foot. The shape of the air bags permits their deformation to accommodate the contours of the patient's body without undue local pressure areas developing. The pressure within the air bags is adjusted to give just the required support to each portion of the patient's body and the adjustment can be changed to periodically vary the pressure on each or all portions for eating, sleeping, etc. Such use of air bags greatly reduces the tendency for bed sores to form and, indeed, can promote the healing of already formed bed sores. Typically, small streams of air are ejected from the upper sections of the air bags which are covered by a vapor-permeable sheet, such as a microporous polyurethane-coated nylon fabric. The streams of air dry any moisture vapor which permeates through the sheet and, therefore, helps remove another cause of bed sores and reduces the frequency of bedding changes. A discussion of the formation and prevention of bed sores, as well as some conventional types of low loss air beds may be found in *Bed Sore Biomechanics*, edited by R. M. Kenedi, J. M. Cowden, and J. T. Scales, Macmillan Press Ltd. publisher, 1976, which book and the references cited therein are made a part hereof by reference.

Conventional air beds typically include features found on standard hospital beds such as means to raise or lower head and/or foot portions, means to adjust the height of the bed, etc. Frequently, such air beds consume a relatively large volume of air, thus requiring a relatively large blower and creating a noise problem from the air flow and the controls therefor unless extraordinary measures are taken to dampen the noise. It would be desirable to have an air bed having low air flow requirements and having air flow control components which inherently produce a low noise level.

Perhaps the greatest disadvantage with conventional air beds is that of high manufacturing cost. Such beds are fabricated from numerous small parts manually attached with fasteners and complex weldments and having a high labor content. Also, some of the features which are included in standard hospital beds contribute to the high cost. The result of the high cost is that the use of such beds is restricted almost entirely to hospitals that have the financial means to purchase or rent such beds and, thus, immobile patients who otherwise could be discharged to a nursing home or private home must be maintained in the formal hospital setting. It would be highly desirable to have available an air bed which could be afforded by those outside of a formal hospital setting.

Another class of persons subject to pressure sores are those who are handicapped and working, but who are confined to wheelchairs. The day-long confinement to a wheelchair causes the same problem with pressures sores as does confinement in a bed. In such a situation, when the person develops one or more such sores, the person must drop out of the person's position in society for a month or more while the sore is cured. Of course, when the person returns to the wheelchair, sores will likely recur and the process is repeated. It has been found that, if such a person is able to sleep in an air bed, such permits incipient sores to heal during the night, even though the person is confined to a wheelchair during the day. Unfortunately, the cost of a conventional air bed puts it out of the reach of many such persons who must continue to suffer.

A further factor contributing to the relatively high cost of conventional air beds is the arrangement of the air bags. Typically, the bags are arranged in groups of three to five bags each with the bags in a group supplied with air of the same pressure through a manifold. It would be simpler to have a single air bag approximating the dimensions of three or more conventional air bags, but simply making one bag larger would cause that bag to approach a spherical shape, thus making it unsuitable for patient support. However, it would be desirable to have available a single air bag which would simulate a group of conventional air bags. Such a single bag would simplify the air supply arrangement and be more economical to manufacture.

An important cost factor in the use of conventional air beds is their lack of portability. This means that shipping and installing such beds requires a relatively costly procedure and, of course, it is impossible for an ambulatory or wheelchair bound patient requiring an air bed to conveniently relocate, or have relocated, such a bed. It would be desirable to have a device with the therapeutic features of an air bed, but one that is highly portable and can easily be shipped by conventional mail or by commercial parcel delivery services and which can be easily relocated.

Another feature of standard hospital-type beds that can contribute to their high cost, and also that contributes to difficulty in their use by the patient or the patient's aide, is the siderails employed with such beds. Typically, such siderails are of one of two types. One type comprises a single-piece tubular siderail structure which extends substantially the length of the bed and which must be lifted off to allow the patient to be moved or, if the patient is mobile, to allow the patient to exit or enter the bed. Removal and replacement can be difficult for the aide and impossible for the impatient. The other typical type comprises a similar siderail structure which has a complicated and expensive hinged mechanism to allow the siderail to be lowered to the floor. This may be more convenient for the aide, but is impossible for the patient to maneuver if the patient is in the bed.

Accordingly, it is a principal object of the present invention to provide a bed structure which is simple and economical to manufacture and which may be used in a number of applications, including air beds.

A further object of the invention is to provide a air bed which is simple and economical to manufacture and which may be used in nursing homes or private homes.

Another object of the invention is to provide an air flow control valve which inherently produces a low level of noise, which is economical to manufacture, and which may be used for air flow control on air beds.

An additional object of the invention is to provide a single air bag which simulates a plurality of conventional air bags and which may be used for air beds.

Yet an additional object of the invention is to provide a bed siderail which is relatively economical and which is easy to manipulate either by the patient unattended or the patient's aide.

Yet another object of the invention is to provide a device offering the features of an air bed, but one which is highly portable and may be shipped by conventional mail or by commercial parcel delivery services.

Other objects of the invention, as well as particular features and advantages thereof, will, in part, be obvious and will, in part, be apparent from the following description and the accompanying drawing figures.

SUMMARY OF THE INVENTION

The present invention accomplishes the above objects, among others, by providing, in one aspect of the invention, a bed structure having a mattress deck panel and side panels, with internal reinforcing bulkheads and single-piece head- and footboards serving as reinforcing bulkheads at the head and foot of the structure. In another aspect of the invention, there is provided a low-cost air bed employing the above structure. In an additional aspect of the invention, there is provided an air bed which incorporates the air supply and control components within the bed structure itself. In a further aspect of the invention, there is provided a low-noise air flow control pinch valve. In yet another aspect of the invention, there is provided a single air bag which simulates multiple air bags through the use of welded internal baffles. In yet an additional aspect of the invention, there is provided a bed siderail which is patient-operable.

In yet a further aspect of the invention, there is provided a device having the features of an air bed, which device is highly portable and which can be shipped by conventional mail or by parcel delivery services.

DESCRIPTION OF THE PREFERRED EMBODIMENTS

Figure 1:
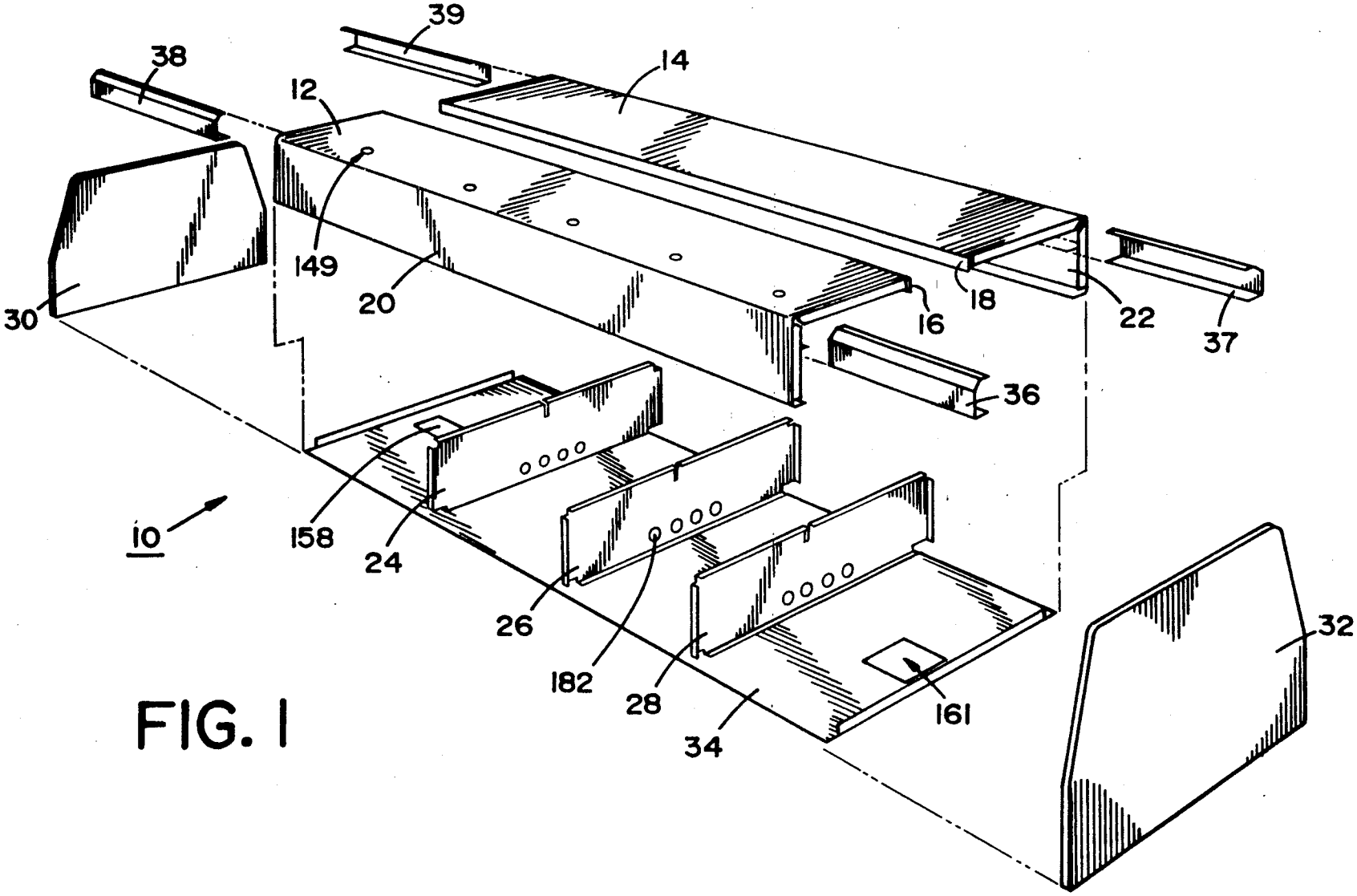
FIG. 1 is an exploded perspective view of bed structure according to the present invention.
Figure 2:
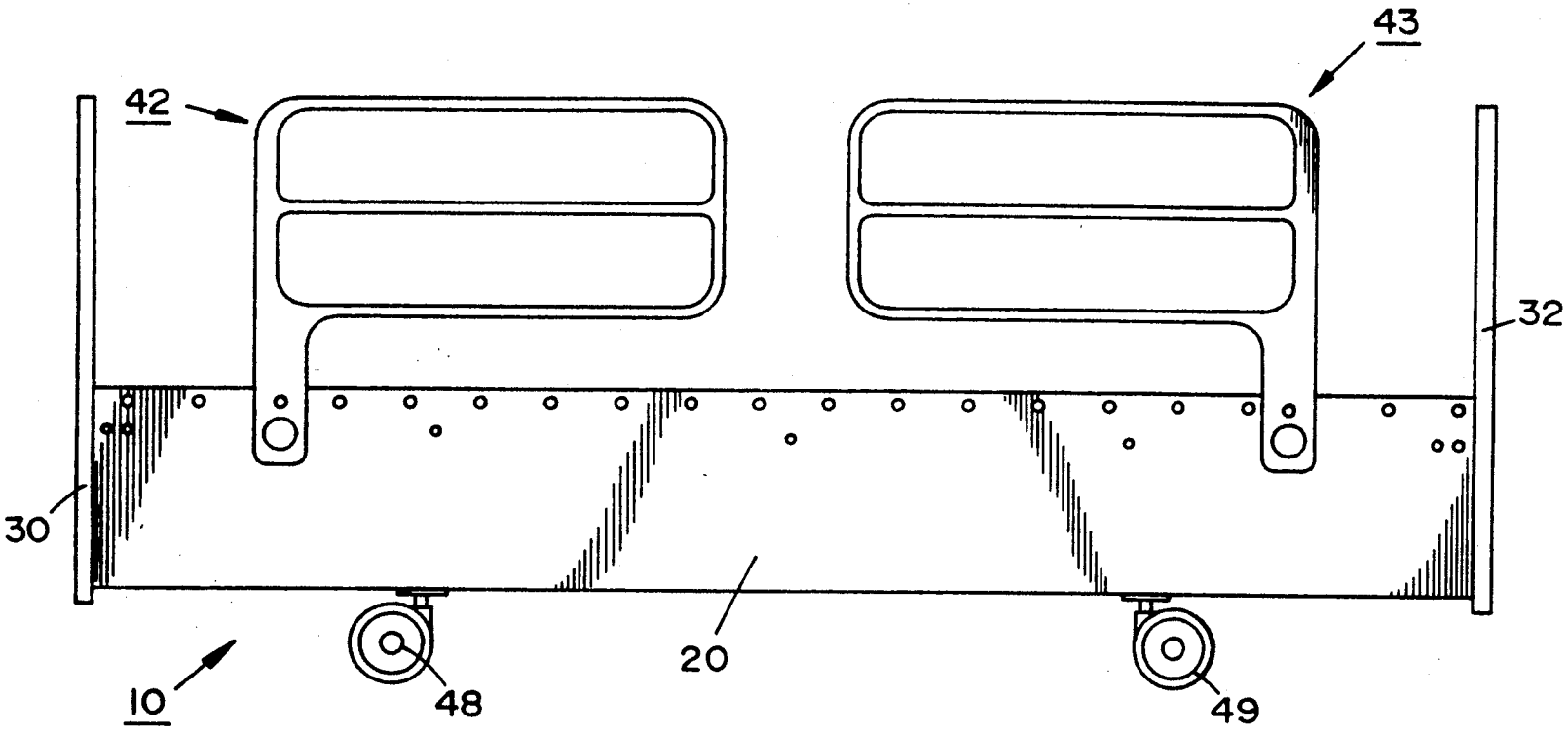
FIG. 2 is a side elevation view of the assembled bed structure of FIG. 1.
Figure 3:
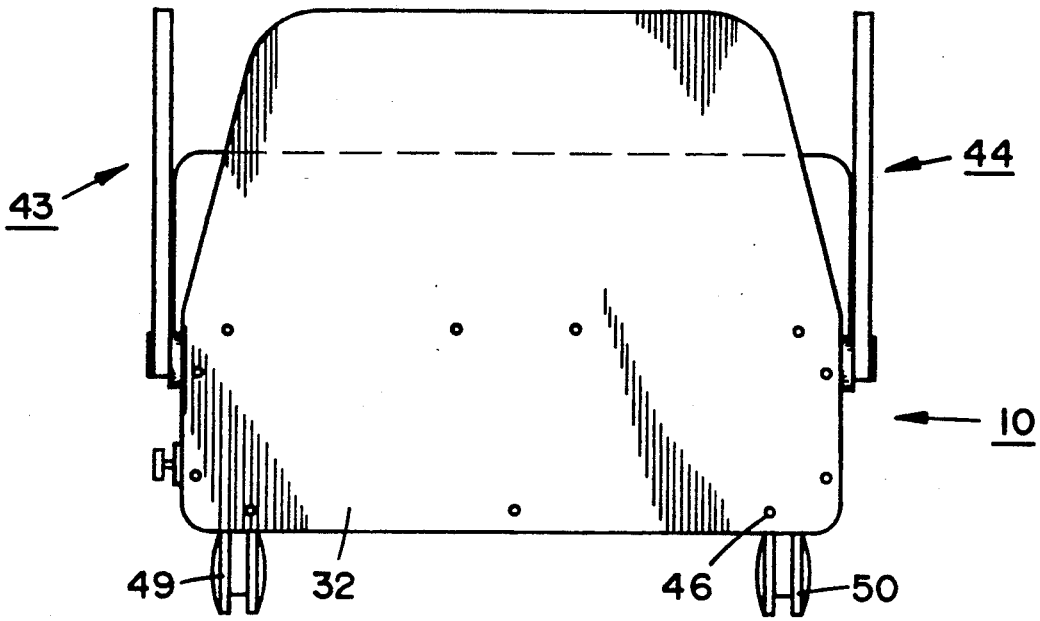
FIG. 3 is an end elevation view of the assembled bed structure of FIG. 1.
Figure 4:
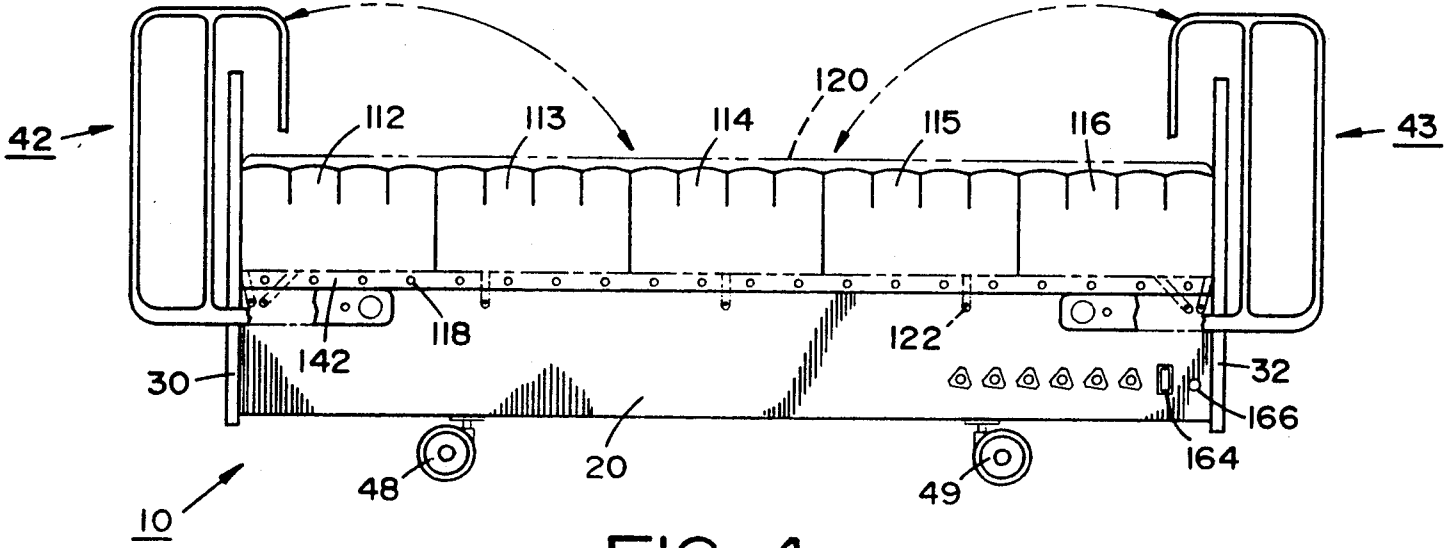
FIG. 4 is a side elevation view of the assembled bed structure of FIG. 1 adapted for use as an air bed.

Referring now to the Drawing in which identical or similar elements are given the same reference numerals throughout the various figures thereof, FIG. 1 is an exploded perspective view of the bed structure of the present invention, generally indicated by the reference numeral 10, and FIGS. 2, 3, and 4 are, respectively, side elevation, end elevation, and side elevation views of the bed structure assembled, with FIG. 4 showing the bed structure adapted for use as an air bed. Bed structure 10 includes first and second deck panels 12 and 14 having flanges 16 and 18 running the length of deck panels 12 and 14, respectively, and extending orthogonally downward from the inner edges thereof. Flanges 16 and 18 can be joined along the length thereof to form a flat horizontal deck.

Extending orthogonally downward from the outer edges of first and second deck panels 12 and 14, respectively, are side panels 20 and 22. Reinforcing bulkheads 24, 26, and 28 are provided for attachment to deck panels 12 and 14 and side panels 20 and 22. Completing the basic bed structure are headboard 30 and footboard 32 attached to either end of the structure formed by attached deck panels 12 and 14 and side panels 20 and 22.

Although the basic bed structure may be employed using only the elements described above, its weight capacity would be somewhat limited. Accordingly, a bottom panel 34 may be provided for attachment to bulkheads 24, 26, and 28 and headboard 30 and footboard 32 for greater reinforcement to permit higher weight capacity. As will be described below, bottom panel is also useful when bed structure 10 is to be used in a low loss air bed embodiment.

Bed structure 10 is thus formed entirely without structural members; that is, without vertical and horizontal posts and stringers to which the various panels thereof might otherwise be attached—the panels themselves providing sufficient rigidity when attached to each other that such structural members are unnecessary. Therefore, bed structure 10 may be referred to as being "frameless."

Reinforcing members 36, 37, 38, and 39 may be provided for attachment at the intersections of deck panels 12 and 14 and side panels 20 and 22 to help provide support for siderail structures, as generally indicated by the reference numerals 42, 43, and 44 (FIGS. 2–4), when such siderail structures are used with bed structure 10.

For convenience in moving bed structure 10, lockable casters, as at 48, 49, and 50, may be provided at the lower edges of side panels 20 and 22.

Deck/side panels 12/20 and 14/22, bulkheads 24, 26, and 28 bottom panel 34 and reinforcing members 36–39 are preferably formed from steel sheet and attached by spot welding or riveting. The foregoing elements may be 18-gauge in thickness. Headboard 30 and footboard 32 are preferably constructed of plastic-faced composition board and attached by means of machine screws, as at 46 (FIG. 3). Other materials and attachment methods for the above elements may be employed, if desired.

The seams formed between flanges 16 and 18 and between deck panels 12 and 14 and headboard 30 and footboard 32 are preferably sealed with a suitable conventional sealant to prevent liquids from seeping below the deck panels.

Figure 5:
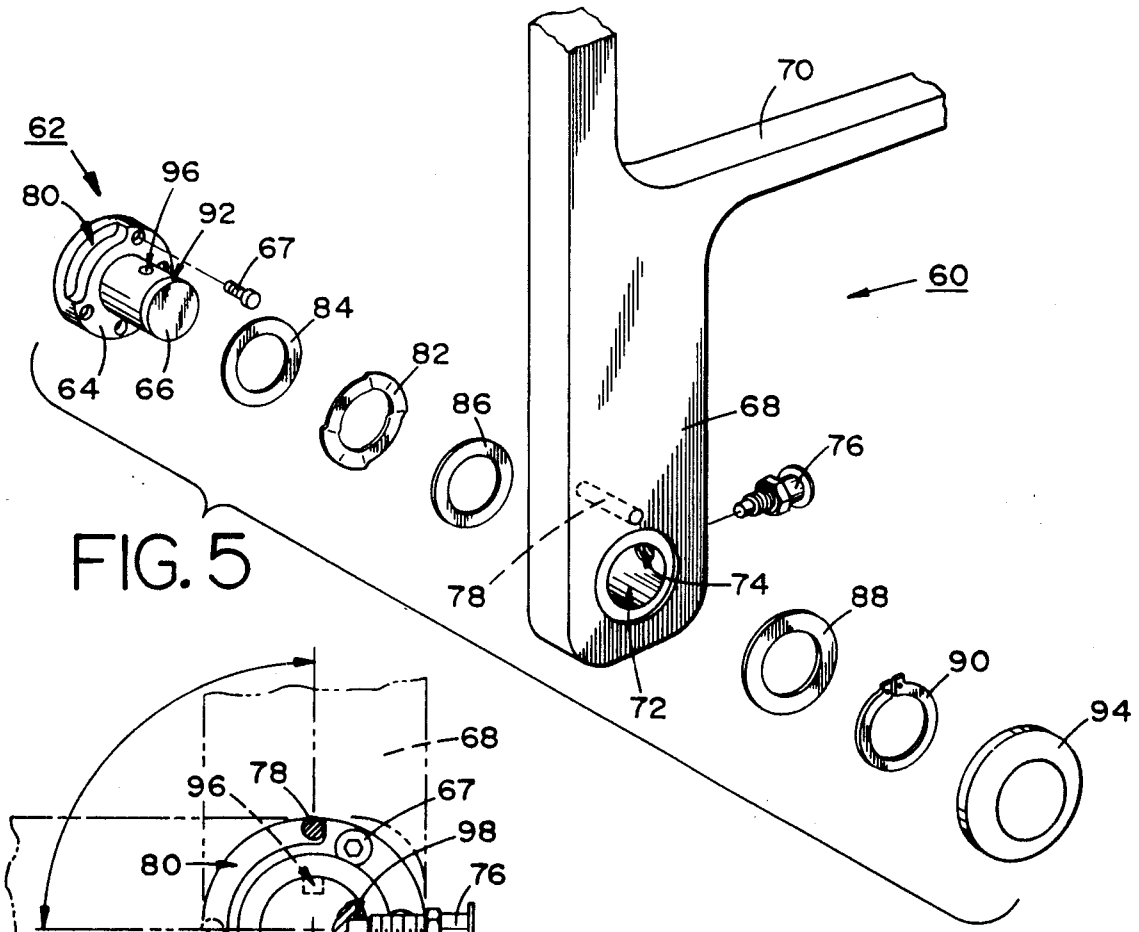
FIG. 5 is a fragmentary exploded perspective view of the siderail structure according to the present invention.
Figure 6:
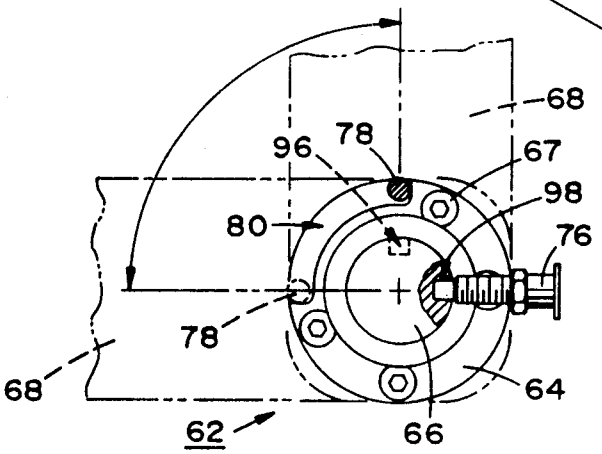
FIG. 6 is a detail of FIG. 5.

FIG. 5 is an exploded perspective view of a portion of a typical siderail structure, generally indicated by the reference numeral 60, and FIG. 6 is a detail thereof. Siderail structure 60 includes a mounting boss, generally indicated by the reference numeral 62, which includes a flange portion 64 and a shaft portion 66. Flange portion 64 may be mounted to the side of a bed (not shown) by means of rivets or screws, as at 67. Siderail structure 60 further includes a vertical member 68 and a horizontal gate member 70 formed as an horizontal extension of the vertical member. Defined in the lower end of vertical member 68 is a round opening 72 sized to closely moveably engage shaft portion 66 of mounting boss 62, and a threaded hole 74 extending from one edge of the vertical member to the round opening and sized for moveable engagement with threaded spring-loaded locking pin 76. Completing siderail structure 60, when assembled, is a stop pin 78 fixedly disposed at the lower end of vertical member 68 for moveable engagement with a groove 80 defined in flange 64 of mounting boss 62, a spring washer 82 captured between flat spacers 84 and 86, the latter spacers bearing against flange 64 and the back surface of the vertical member, respectively, a flat spacer captured between the front surface of the vertical member and a retaining ring 90 which releasably engages an annular groove 92 on shaft portion 66 of mounting boss 62, and a trim cap 94 which is attached to the distal end of shaft portion 66.

In use, siderail structure 60 may be rotated 90 degrees between a closed position, as indicated by the positions of siderail structures 42 and 43 on FIG. 2, and an open position, as indicated by the positions of siderail structures 42 and 43 on FIG. 4. When in its closed position, stop pin 78 engages the upper end of groove 80, as shown in solid lines on FIG. 6, thus holding the siderail structure against clockwise motion. To move siderail structure 60 to its open position, it is rotated 90 degrees counterclockwise so that stop pin 78 engages the lower end of groove 80, as shown in dashed lines on FIG. 6, thus preventing further counterclockwise motion of the siderail structure. Because the center of gravity of siderail structure 60 is relatively close to its balance point when the siderail structure is rotated in either direction, it is relatively easy to operate it through a full cycle. To move sidewall structure 60 from its open position, one need only exert relatively light pulling force on it. Thus, sidewall structure 60 is patient-operable.

Spring washer 82 introduces sufficient friction into the movement of siderail structure 60 to impede the motion thereof, thus preventing slamming of the siderail structure from position to position.

If it is desired to lock siderail structure 60 into either its open or its closed position, one engages locking pin into hole 96 or hole 98 (FIG. 6), respectively, defined in shaft 66 on mounting boss 62. Locking pin 76 may be engaged into either locked position by rotating the distal end of the spring-loaded pin 90 degrees from the rest position, thereby permitting selective indexing in either open or closed positions.

Siderail structure 60 may be formed of any suitable material, but is preferably formed from die cast aluminum and suitably dimensioned for appropriate strength.

Other elements of siderail structure 60 may be constructed of any suitable conventional materials.

In addition to providing a relatively light, easily maneuverable siderail structure, the present invention, employing two siderails on each side of a bed, has an additional advantage. With a partially mobile patient, the siderail structure at the foot of the bed may be opened, while the that at the head of the bed remains locked in its closed position, so as to allow the latter to be used as a hand-hold to assist the patient in exiting and entering the bed.

While bed structure 10 may be used as a light and low-cost support of standard composite mattresses, air mattresses, or water mattresses, it is especially suited for adaptation to use as an air bed, as will be described below.

Referring now to FIG. 4, there is shown, in side elevation, bed structure 10 adapted for use as an air bed, including air bags 112, 113, 114, 115, and 116 disposed on the deck (not shown) of the bed structure. Air bags 112–116 are held in place in abutting relationship between headboard 30 and footboard 32 by fastening to the side panels, such as side panel 20 by means of snaps, as at 118. Over air bags 112–116 may be disposed a vapor-permeable mattress pad 120 which is held in place by fastening to side panel 20 by means of snaps, as at 122. Mattress pad 120 may be a microporous polyurethane-coated nylon fabric.

Figure 7:
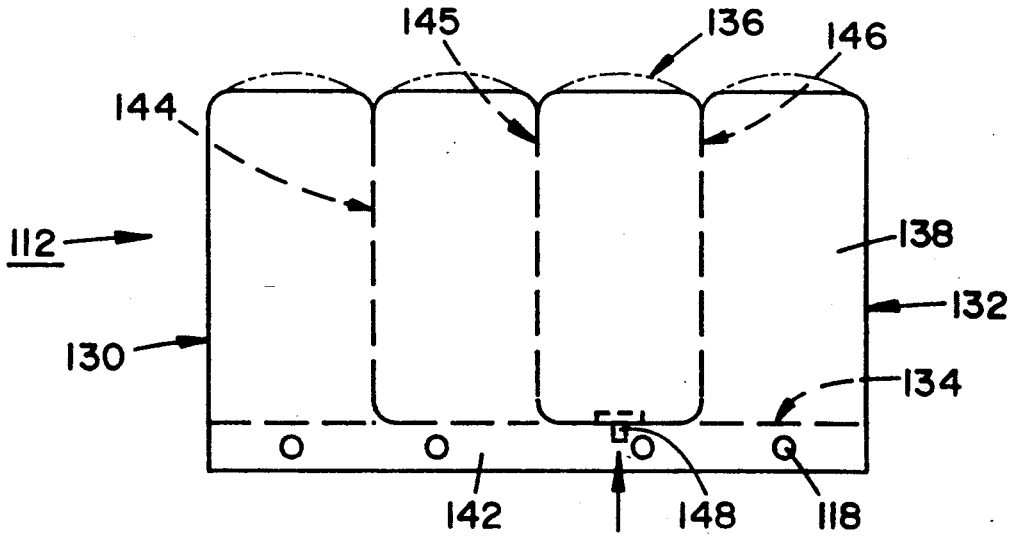
FIG. 7 is a side elevation view of an air bag constructed according to the present invention.
Figure 8:
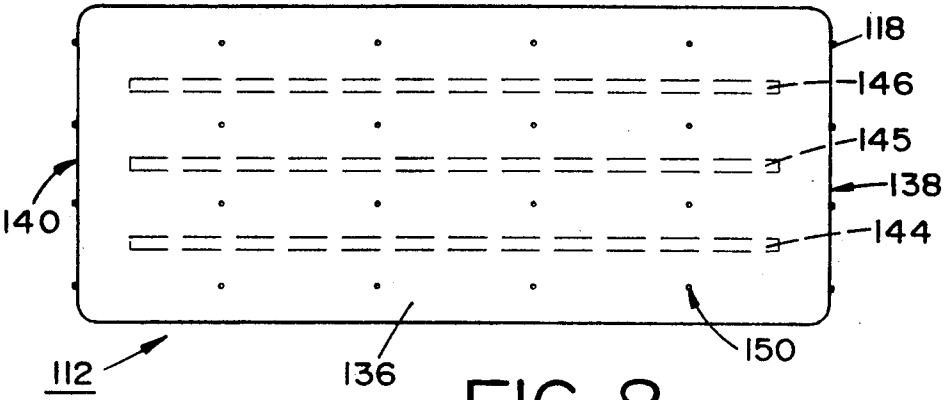
FIG. 8 is a top plan view of the air bag of FIG. 7.

The construction of a typical air bag, air bag 112, is shown in side elevation on FIG. 7 and in top plan view on FIG. 8. Air bag 112 includes rectilinearly disposed ends 130 and 132, bottom 134, top 136, and sides 138 and 140. Formed as a downward extension of side 138 is a snap flap 142 on which are mounted snaps, as at 118. Disposed internally of air bag 112 are bulkheads 144, 145, and 146 extending between and attached to bottom 134 and top 136. Bulkheads 144–146 keep top 136 relatively horizontal and simulate in one bag the shape of four conventional air bags. The convex segments thus obtained yieldably support a patient without material wrapping around the patient. The bag elements may be welded either thermally or with RF sealing equipment. The material of the bags is preferably nylon fabric with an inside polyurethane coating, an air bag fabric known in the art, with the polyurethane material being that which is fused during welding.

Air is supplied to air bag 112 through a nipple 148, which air inflates the air bag. Nipple 148 extends through a hole 149 (FIG. 1) in deck panel 12 for attachment to an air supply hose (element 174 on FIG. 10). The air slowly flows from air bag 112 through orifices, as at 150, defined in top 136 of the air bag. This flow of air dries any moisture which may permeate through comforter 120 (FIG. 4). The air is preferrably supplied to air bags 112–116 at a flow rate of on the order of about 10 CFM and at a pressure of less than 26 mm Hg which is the normal capillary pressure of a normal person. Actual pressures are determined by patient physiology and the need to level the patient's spine for comfort.

Figure 10:
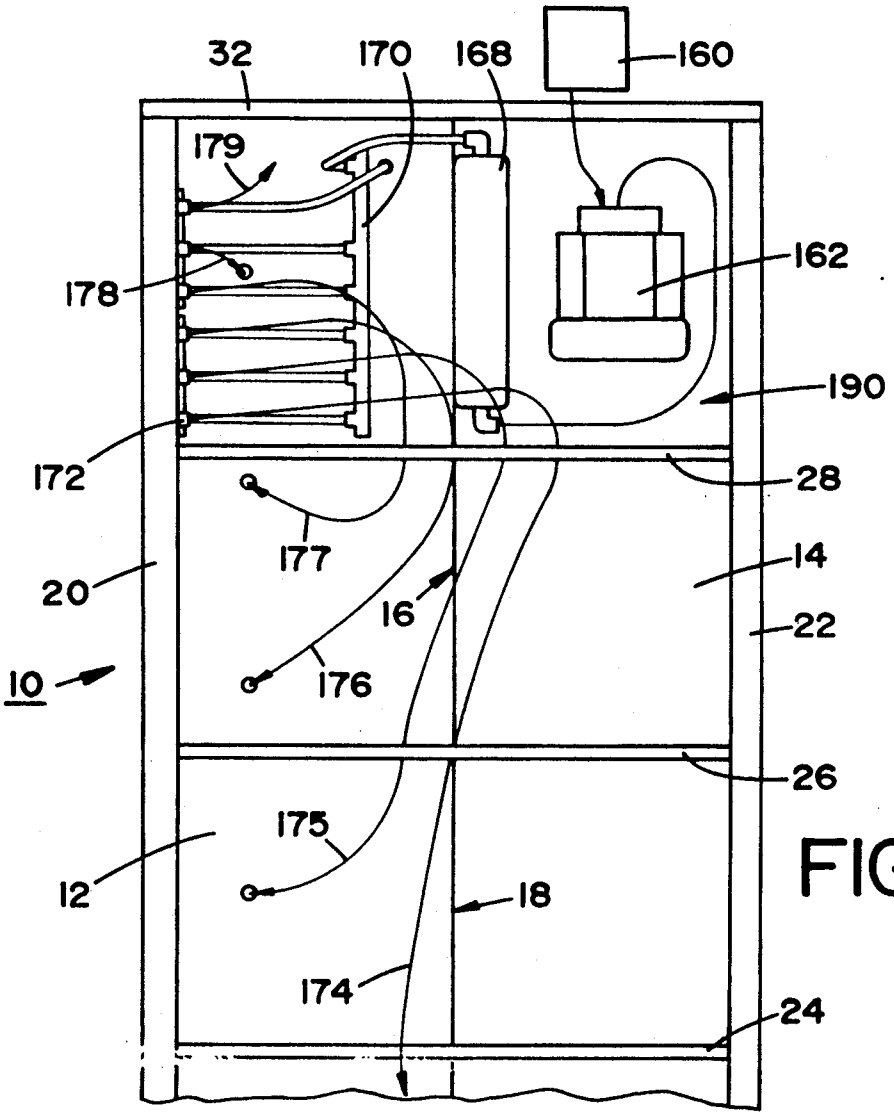
FIG. 10 is a bottom plan view looking up, with the bottom panel removed, of the air bed of FIG. 4.
Figure 9:
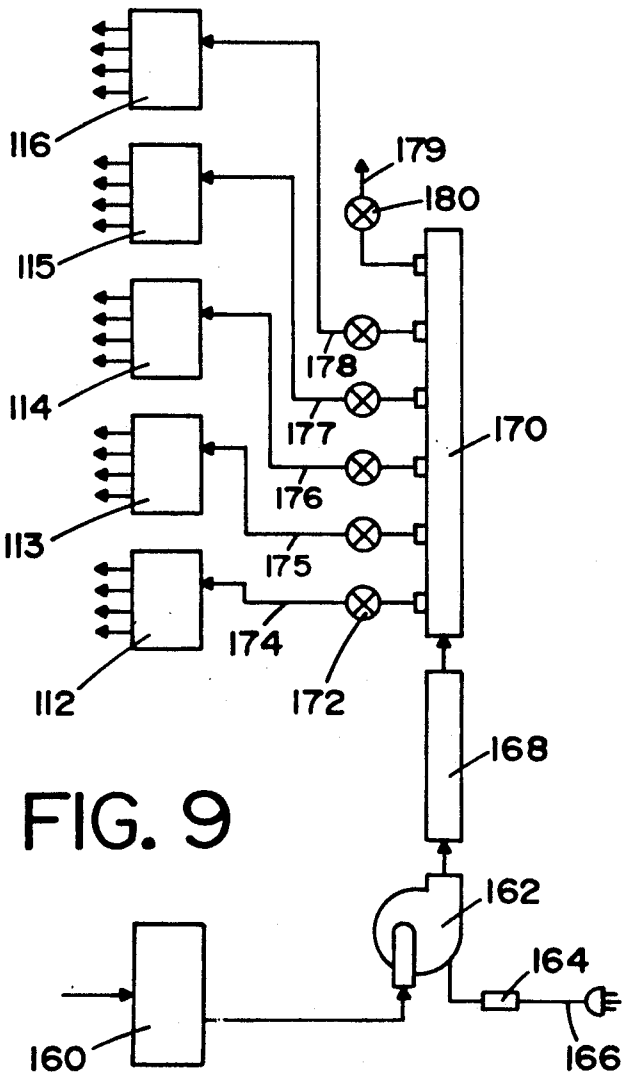
FIG. 9 shows diagrammatically the air supply system of the present invention.

The means by which air is supplied to air bags 112–116 is shown diagrammatically on FIG. 9 and in a fragmentary bottom plan view looking up, with the bottom removed, of bed structure 10 on FIG. 10. Supply air is drawn through an opening 158 defined in bottom 34 near the head end of bed structure 10 (FIG. 1), through the internal space of the bed structure, and through a filter 160 by a blower 162, the motor of which is connected to an on/off switch 164 and an electrical supply cord 166. Filter 160 is not shown in proper position on FIG. 8, as it is actually mounted over opening 161 defined in bottom 34 of bed structure 10 (FIG. 1), the reason for which is described below.

Air from blower 162 passes through an air silencer 168 and to a manifold 170. From manifold 170, the air flows through air flow control valves, such as flow control valve 172 which supplies air bag 112 (FIG. 9), and through hoses 174, 175, 176, 177, 178, and 179. Hoses 174–178 supply air to air bags 112–116, respectively, while hose 179 discharges to the atmosphere from flow control valve 180 so as to permit control of the pressure in manifold 170. The pressure in each of air bags 112–116, and therefore the firmness or softness of each bag, can be controlled through adjustment of its associated flow control valve. With the five air bag arrangement, air bag 112 is disposed so as to provide support for the head of the patient's body, air bag 113 for the back, air bag 114 for the seat, air bag 115 for the thigh, and air bag 116 for the foot. It will be understood, for example, that, on FIG. 10, air bag supply hose 175 is connected to a nipple (not shown) to supply air bag 113 with air.

Hoses 174–177 pass through bulkheads 24, 26, and 28, as shown on FIG. 10, through openings defined in the bulkheads, as at 182, each of which bulkheads is shown as having defined therein four openings, so as to provide economy in the use of a standard part.

Filter 160 may be a conventional filter/silencer, blower 162 may be a conventional regenerative pressure blower, and silencer 168 may be a conventional silencer, all as are commercially available.

FIG. 10 also illustrates how joined flanges 16 and 18 form a reinforcement member along the longitudinal axis of bed structure 10.

Reference to FIGS. 1 and 10 indicates some of the low noise features of the present invention as applied to air beds. First, the air supply components are disposed in a cavity 190 defined by deck/side panels 12/20 and 18/22, bulkhead 28, footboard 32, and bottom 34, with no openings directly from the cavity to the surroundings. Blower 162 is mounted to deck panel 14 rather than to bottom 34, which mounting position tends to deaden sound and vibrations produced by the blower. Rather than have air enter cavity 190 directly from the surroundings, which would present an opening for the exiting of sound, the air is drawn through opening 158 at the opposite end of bed structure 10 and flows to the cavity at relatively low velocity around bulkheads 24, 26, and 28 and through holes 182 in the bulkheads. As described below with reference to FIG. 12, filter 160 covers and seals opening 161 in cavity 190.

Figure 11:
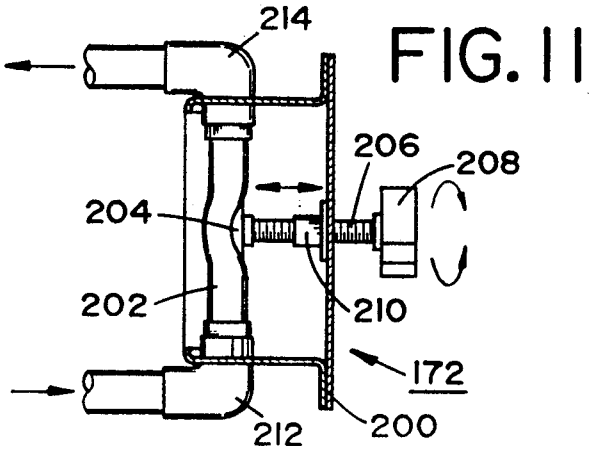
FIG. 11 is a side elevation view of an air flow control valve according to the present invention.

A further aspect of the present invention which affords low noise level is the construction of the flow control valves, such as flow control valve 172 shown in side elevation on FIG. 11. Here, control valve 172 is mounted in a frame and includes a section of flexible tubing 202 a portion of the diameter of which may be constricted by the advancement of a convex member 204 disposed at one end of a threaded shaft 206, at the other end of which shaft is fixedly attached a knob 208. Shaft 206 passes through an internally threaded boss 210 which is fixed to frame 200. Preferrably, a lubricant is disposed between tubing 202 and convex member 204. Fitting 212 is connected to tubing 202 to supply air thereto and fitting 214 is connected to the tubing to supply air therefrom. As is evident from FIG. 11, rotating shaft 206 so as to advance convex member 204 against the wall of tubing 202 will cause the flow of air through valve 172 to be diminished, while withdrawing convex member 204 will increase the flow of air. It has been found that the shape formed by tubing 202 as it is constricted inherently causes very little noise to be produced as air flows through the tubing, due to the shallow entry angle and smooth bore, in contrast to the gate valves typically used in such air supply systems, which gate valves are inherently noisy.

Figure 14:
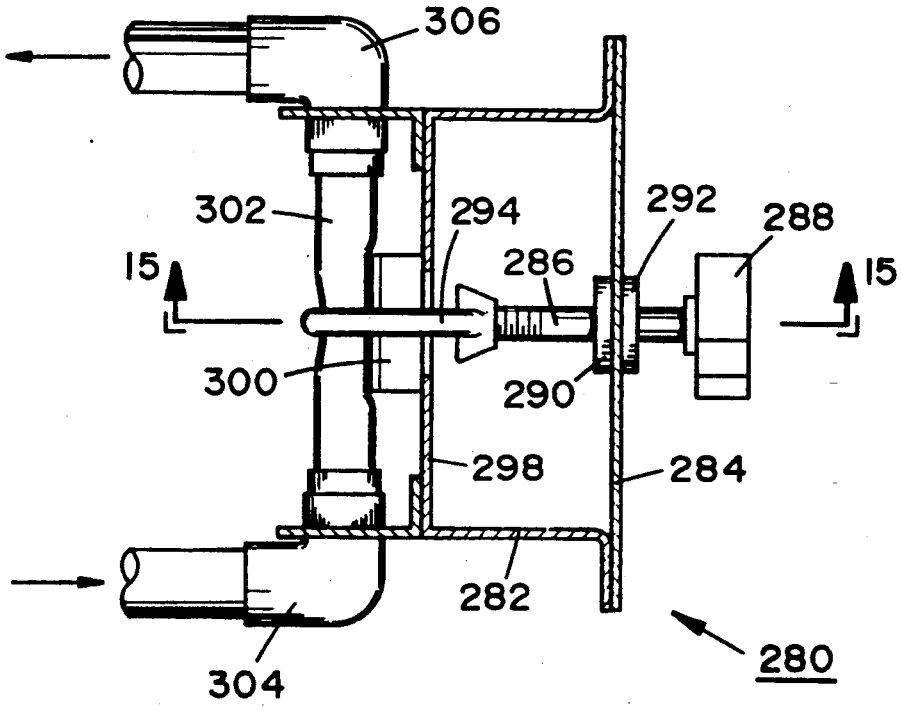
FIG. 14 is a side elevation view of another embodiment of an air flow control valve according to the present invention.
Figure 15:
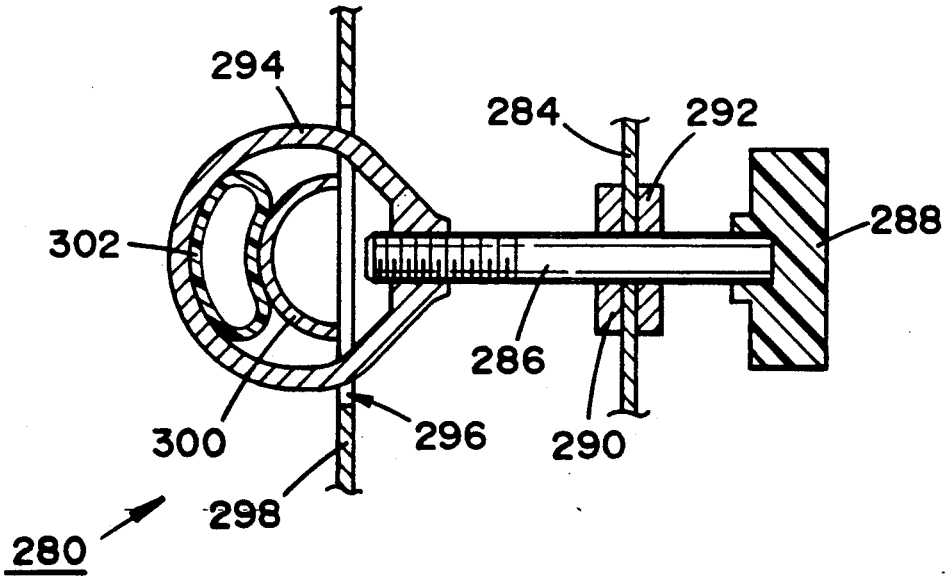
FIG. 15 is a cross-sectional top plan view of the flow control valve of FIG. 14.

FIGS. 14 and 15 illustrate another embodiment of a flow control valve according to the present invention, generally indicated by the reference numeral 280. Flow control valve includes a generally rectilinear box-shaped bracket or frame 282 through one wall 284 of which frame a partially threaded shaft 286 is rotatably disposed. Shaft 286 may be manually rotated by means of a knob 288 fixedly attached to the distal end of the shaft. Collars 290 and 292 fixed to shaft 286 adjacent either side of wall 284 maintain the shaft in fixed axial relationship with the wall.

The threaded proximal portion of shaft 286 engages the threaded end of a yoke 294 the arms of which extend through a slot 296 formed in a wall 298 of frame 282. Assuming a normal right hand thread on shaft 286, it can be seen from FIGS. 14 and 15 that rotation of shaft 286 in the clockwise direction will cause yoke 294 to be drawn to the right, while rotation of shaft 286 in the counterclockwise direction will cause yoke 294 to be pushed to the left.

Fixed to the outer side of wall 298 and maintaining yoke 294 in slot 296 is an anvil 300 having an outwardly convex cylindrical shape. Disposed within the arc formed by the joined arms of yoke 296 is a flexible tube 302 which has a fitting 304 at one end thereof to supply air thereto and a fitting 306 at the other end thereof to supply air therefrom. Tube 302 is disposed so that its axis is parallel to the axis of cylindrical anvil 300.

It can be seen from inspection of FIGS. 14 and 15 that rotation of shaft 286 in the clockwise direction will cause yoke 294 to press tube 302 against anvil 300 resulting in the formation of a construction of the tube between the yoke and the anvil, thus decreasing the rate of flow of air therethrough. Substantially the entire periphery of tube 302 is contained at the plane of constriction, with yoke 294 engaging at least one-half the outer periphery of tube 302 and anvil 300 engaging a large portion of the balance of the outer periphery of the tube, so that very precise and repeatable flow control may be achieved.

It has been found that PVC tubing is an especially suitable material for tubing 202 and, for the above application, tubing with a ⅝-inch ID and a ⅛-inch wall thickness is preferable.

Figure 12:
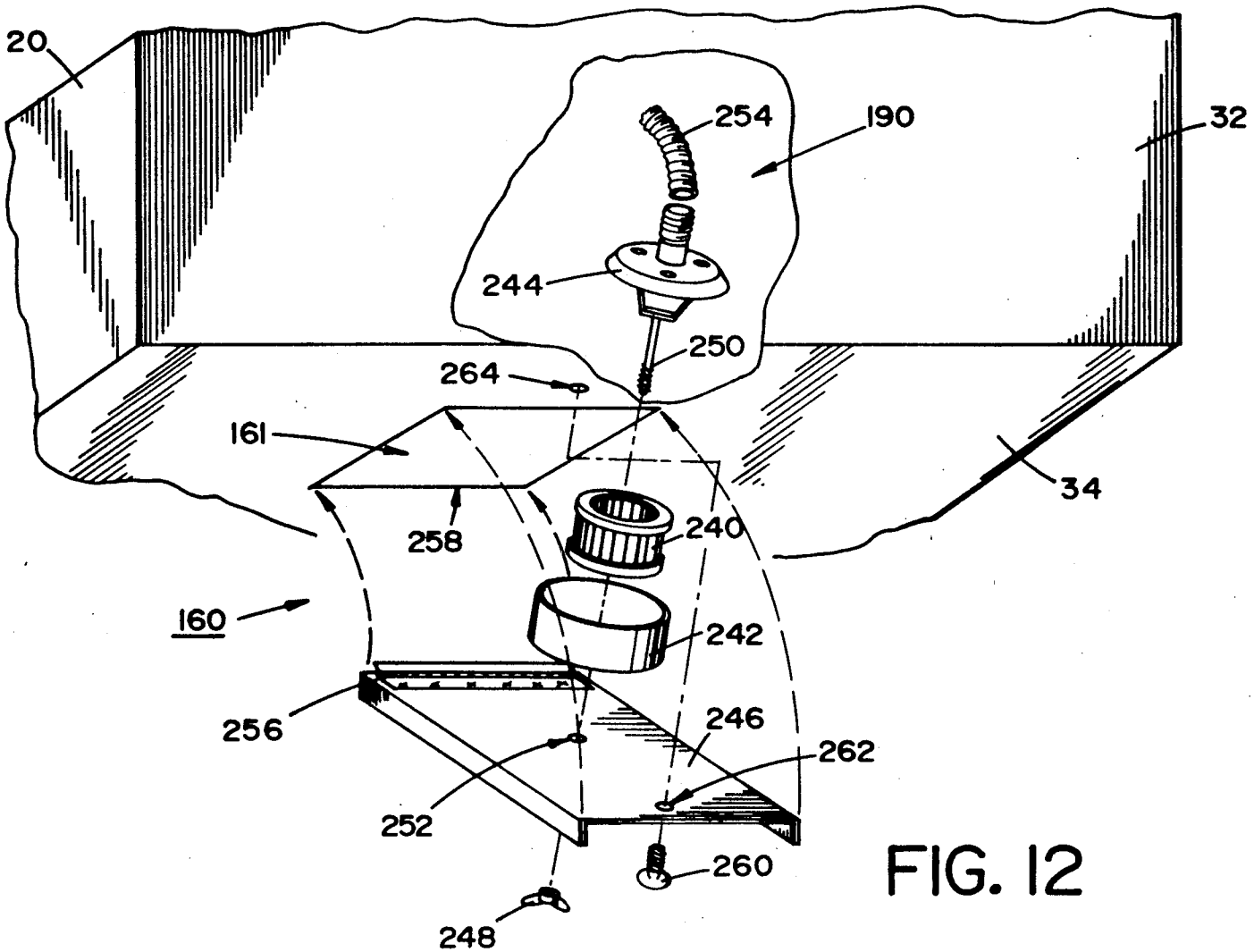
FIG. 12 is a fragmentary, partially sectional, exploded perspective view showing the construction and means of mounting the air filter of FIGS. 9 and 10.

FIG. 12 is a exploded perspective detail view showing the arrangement of filter 160. Filter 160 includes a pleated filter element 240 which fits concentrically in a housing 242 and an end cap 244 which fits over the end of the filter element and is held in place, and holds the filter element in the housing and the housing on a plate 246, by means of a wing nut 248 which engages the threaded end of a retaining stud 250 attached to one end of the end cap and which is passed through a hole 252 on the plate. A hose 254 is attached to the other end of end cap 244 to supply filtered air to blower 162 (FIGS. 9 and 10).

Filter 160 is mounted to, and closes, opening 161 in bottom panel 34 by engaging a flange 256 formed on plate 246 with an edge 258 of the opening, as shown by the dashed arrows, and then rotating the plate into its closed position against the bottom panel, also as shown by the dashed arrows, and securing it in that position by inserting the threaded end of a mounting screw 260 through a hole 262 formed in the plate and then advancing the mounting screw into a threaded hole 264 formed in the bottom panel.

When thus mounted, air enters filter 160 from cavity 190 (FIG. 10), flows around end cap 244 into the annulus defined between filter element 240 and housing 242, through the filter element, and then through hose 254 attached to the end cap. Air is thus supplied to blower 162 without having any opening directly from cavity 190 to the surroundings, which opening could be a conduit for the transmission of airbourne noise.

The placement of filter 160, as shown on FIG. 12, permits easy access thereto for cleaning or replacement of filter element 240 by simply loosening retaining nut 262 and swinging the filter away from opening 161.

Figure 13:
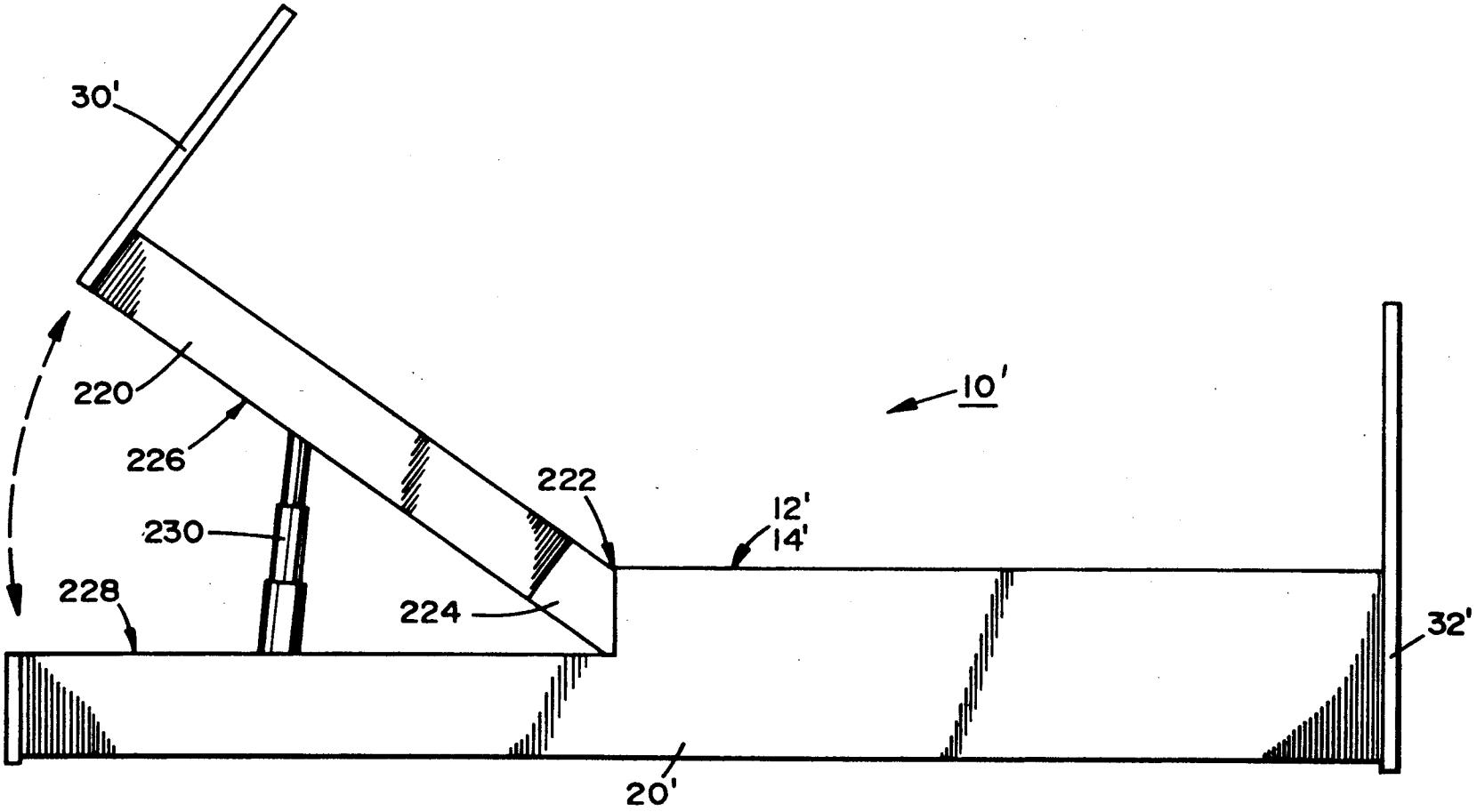
FIG. 13 is a side elevation view of the bed structure of FIG. 2 having a portion of the deck thereof inclinable.

FIG. 13 is a side elevation view of the bed structure of the present invention showing an embodiment thereof in which a portion of the bed deck is inclinable, in which figure, elements the same as, or similar to those shown on FIGS. 1–4 are given primed reference numerals. Here, bed structure 10' is constructed the same as bed structure 10, but first and second deck panels 12' and 14' are divided athwart the bed structure so as to form the top of an inclinable portion 220. Likewise, first and second side panels 20' and 22' are divided (only panel 20' visible) to form the sides of inclinable portion 220, and headboard 30' is divided as shown. Deck panels 12' and 14' may be provided with a hinge structure at 222 and filler panels, as at 224, may be provided for safety. An upper bottom panel 226 may be provided along at the bottom of inclinable portion 220 extending between side panels 20' and 22' and headboard 30' and a lower top panel 228 may be provided extending between the side panels and the headboard. The means by which inclinable portion 220 is raised may be any conventional mechanism known in the art, and may be the telescoping mechanism 230 shown on FIG. 13, and the mechanism used may be adapted by conventional means known in the art to be patient operable.

Inclinable portion 220 permits adjustment of bed structure 10' so that a patient may be placed in a convenient posture for reading or eating. A similar inclinable portion may be provided at the foot of bed structure 10' instead of, or in addition to, inclinable portion 220.

Bed structure 10' is preferably constructed according to the techniques shown and described above with reference to bed structure 10 and may also be adapted for use as an air bed as taught above.

FIGS. 16–21 illustrate an air bed system, generally indicated by the reference numeral 400, which, among other features, is highly portable and which may be employed in a variety of circumstances.

Figure 16:
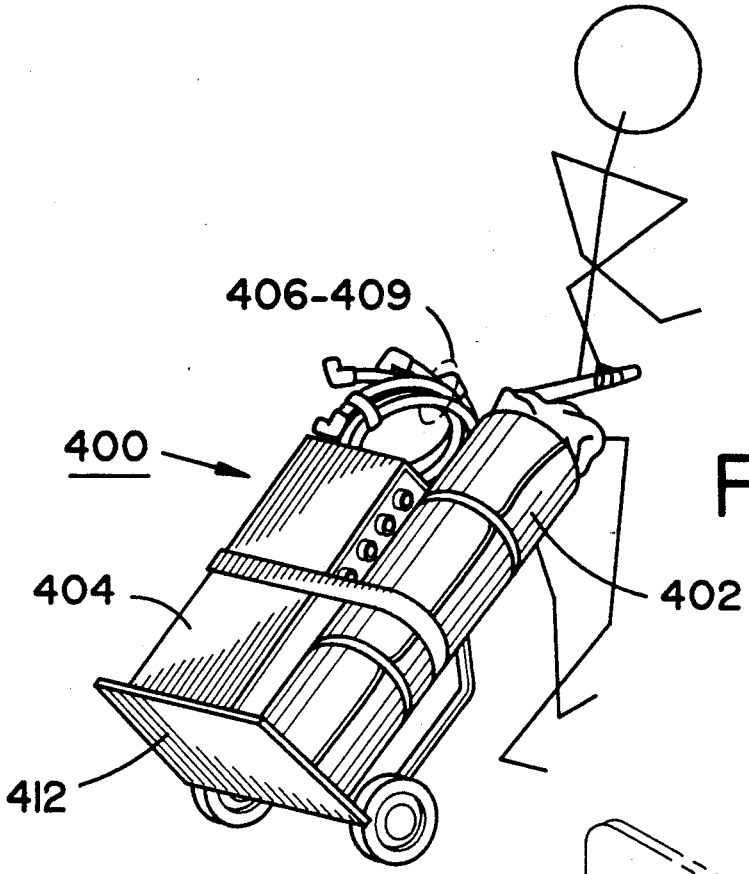
FIG. 16 is a perspective view of an alternative embodiment of an air bed system according to the present invention, being transported on a hand truck.

Referring now to FIG. 16, in which bed system 400 is shown ready for shipping or other relocation, bed system includes only three major elements: a low loss air mattress structure 402, shown deflated and secured in a roll, an air supply 404, and a coil of four air hoses 406–409. As can be seen from FIG. 16, the entire system is secured to a small hand cart 412 for easy transport. Alternatively, bed system 400 could be boxed and, when so boxed, the overall dimensions thereof are, for example, well within the maximum dimensions set by the United Parcel Service of (girth+length=) 130 inches maximum and the weight thereof is less than the UPS maximum of 70 pounds, as well as within the maximum dimensions set by the United States Postal Service of (girth+width=) 100 inches maximum and the weight thereof is less than the USPS maximum of 70 pounds. Thus, a complete low loss air bed system can be sent across the United States for a very modest sum and can be air-freighted anywhere in the world also at relatively low cost.

Figure 17:
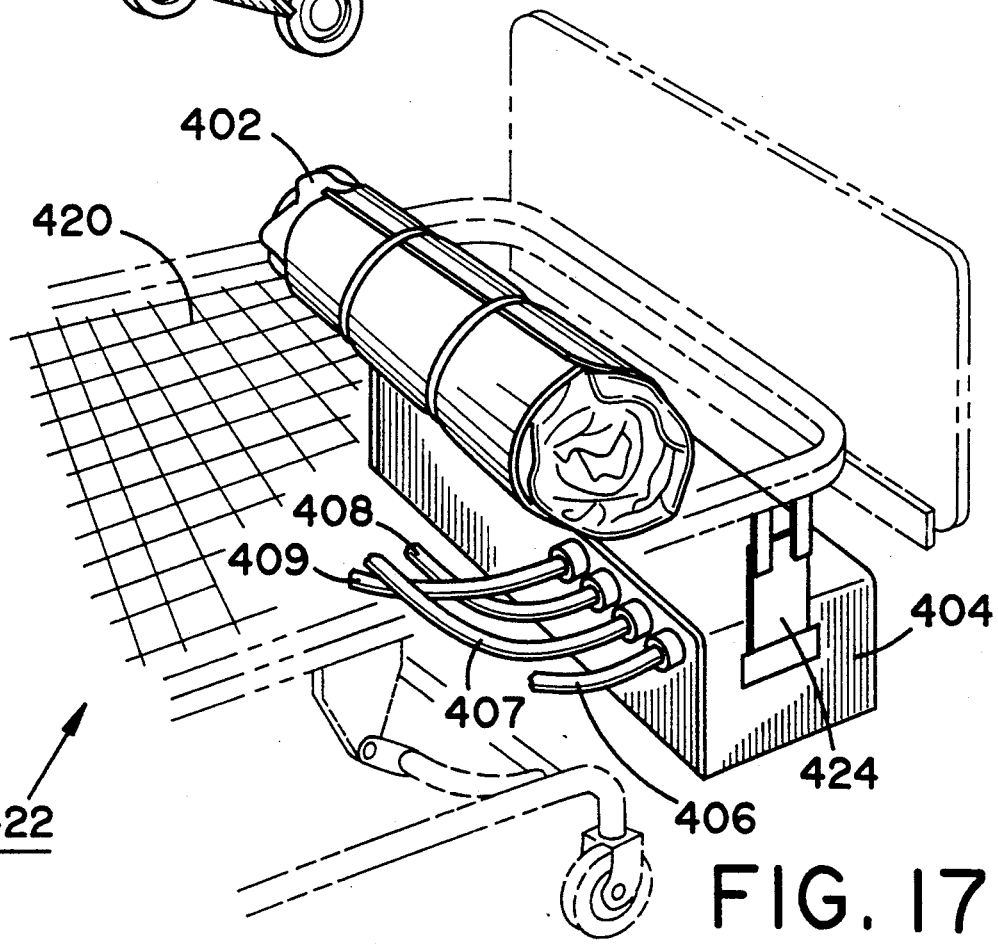
FIG. 17 is a perspective view of the air bed system of FIG. 16, with the mattress structure thereof deflated and rolled, disposed on a hospital bed.

In FIG. 17, mattress structure 402, still in its deflated and rolled state, has been placed on the springs 420 of a standard articulated hospital bed, generally indicated by the reference numeral 422; although, it will be apparent from inspection of the drawing figures and from the following description that the bed system would work quite satisfactory if the mattress structure were placed on any type of bed or even, if necessary, on a large table or on a floor. Air supply 404 has been conveniently hung from a bracket 424 which has been placed over the horizontal frame members of bed 422 and air supply hoses 406–409 have been connected to the air supply. It may be assumed that air supply 404 is similar to that described with reference to FIGS. 9 and 10, except that this air supply has been provided with its own, conventional housing.

Figure 18:
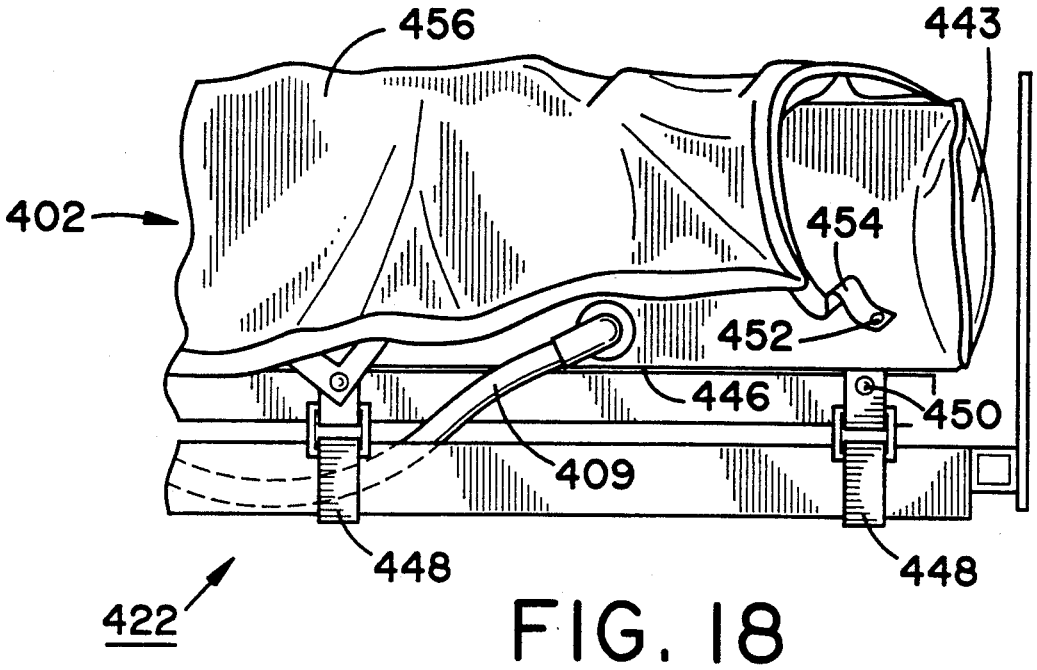
FIG. 18 is a fragmentary side elevation view showing the attachment means for the mattress structure of FIG. 17 and a mattress cover.

On FIG. 18, mattress structure 402 has been unrolled on bed 422 and inflated. Mattress structure 402 comprises, in this case, four air bags 440–443 (only a portion of 443 visible on FIG. 18) of the type described above with reference to FIGS. 4, 7, and 8, attached to a base pad 446. Base pad 446 has attached thereto a plurality of straps, as at 448, which are buckled around the horizontal members of the frame of bed 422 and which hold mattress structure 402 firmly in position on the bed. Disposed on strap 448 is a snap fitting 450 which may be used for attachment thereto of a complementary snap fitting 452 on a strap 454 attached to a mattress cover 456 of the type described above. Thus, mattress cover 456 is firmly held in position over mattress structure 402 without slipping.

As can be seen on FIG. 18, air bag 443 is inflated by means of hoses 409 attached thereto.

Figure 19:
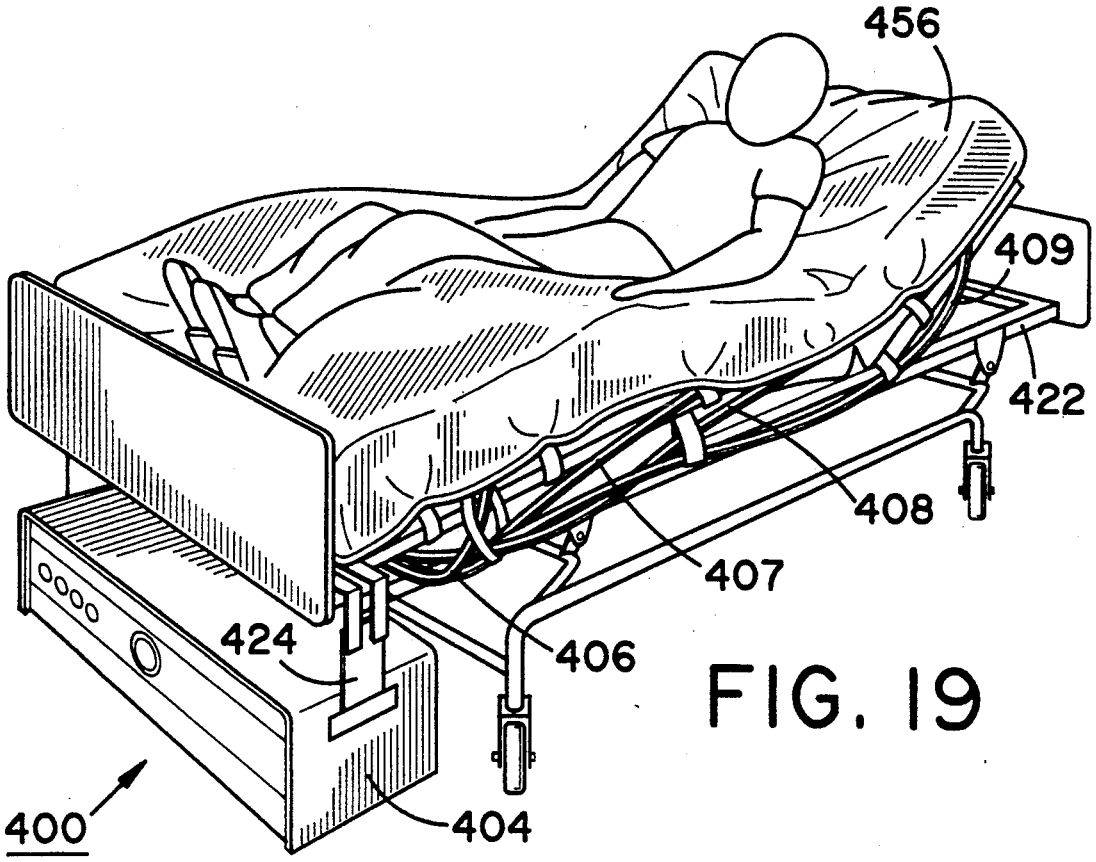
FIG. 19 is a perspective view of a patient reposed on the bed system of FIG. 16.

FIG. 19 shows bed 422 and bed system 400 with a patient reposed thereon, the bed having the back and knee portions thereof elevated. This figure illustrates and important advantage of the air bags of the present invention. With conventional air bags, the ends of the air structure must be supported so that the air bags do not spill over the ends of the bed. Here, as can be seen on FIG. 19, the structural rigidity of the air bags of the present invention permit elevating the head section of bed 422, yet no special provision need be made to support the end of air bag 443 (under mattress cover 456) on that section.

Figure 20:
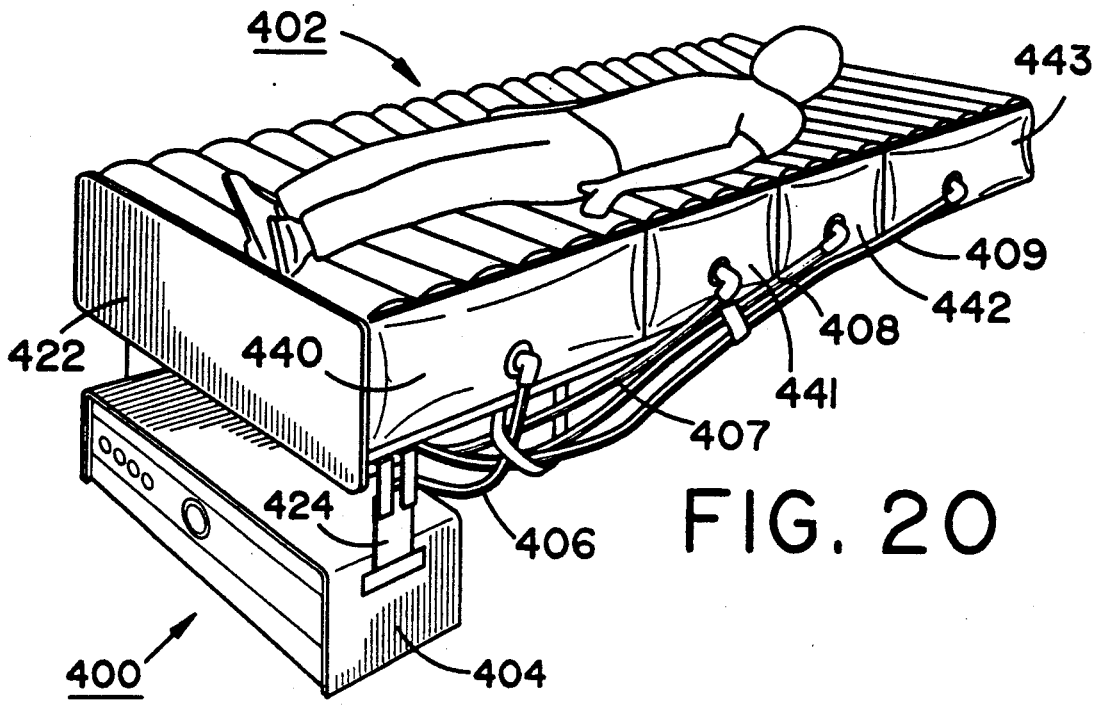
FIG. 20 is a perspective view of a patient lying on the air bed system of FIG. 16, with a fully inflated mattress structure, but with the mattress cover removed.
Figure 21:
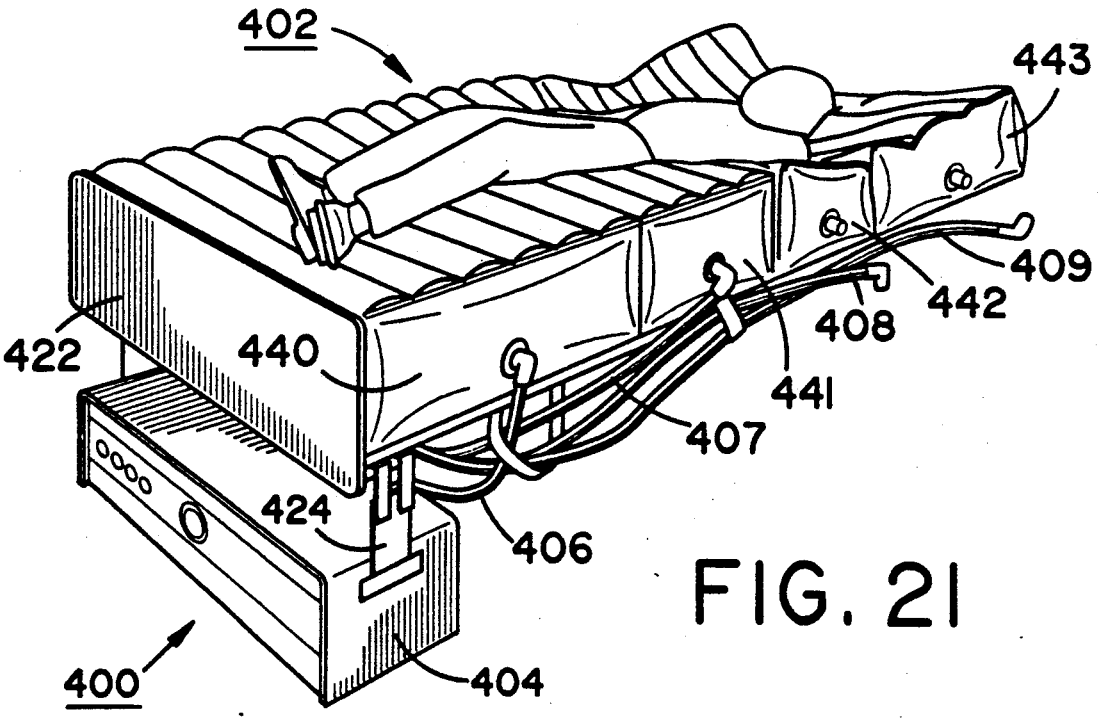
FIG. 21 is a perspective view of a patient lying on the mattress structure of FIG. 20, with the mattress structure partially deflated preparatory to initiating CPR procedures.

FIGS. 20 and 21 illustrate how bed system 400 may be made ready quickly for cardiopulmonary resuscitation (CPR) procedures, which require that the patient's back be supported on a firm surface in order to perform manual chest compressions on the patient. FIG. 20 shows a patient lying on a fully inflated mattress structure 402. (For greater clarity, mattress cover 456 is not shown on FIGS. 20 and 21.) When CPR procedures are indicated, an attendant (not shown) deflates air bags 442 and 443 by grasping the ends of air hoses 408 and 409 at their connections to the air bags and disconnecting them. On FIG. 21, the attendant has disconnected air hoses 408 and 409 from air bags 442 and 443 which have deflated, thus lowering the back and seat portions of the patient to be supported on the surface of base pad 446 (base pad not visible on FIG. 21). CPR can now be started by a person climbing on top of the bed and beginning the procedure. Keeping the foot and thigh portions of mattress structure 402 inflated is preferred, as that causes blood to flow to the head of the patient. The deflation can be accomplished in 8–15 seconds and the air supply controls do not have to be touched.

Figure 22A:
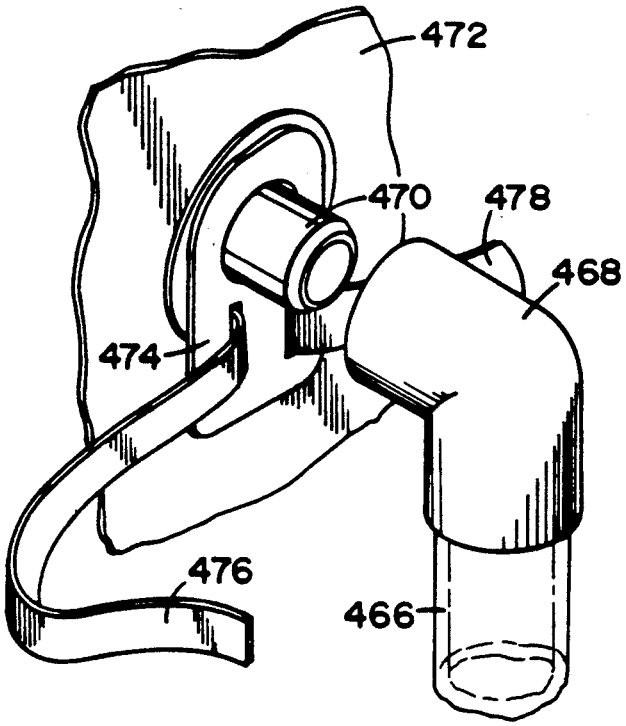
FIGS. 22(*a*) and (*b*) comprise two perspective views illustrating means for releasably attaching an air hose to an air bag.
Figure 22B:
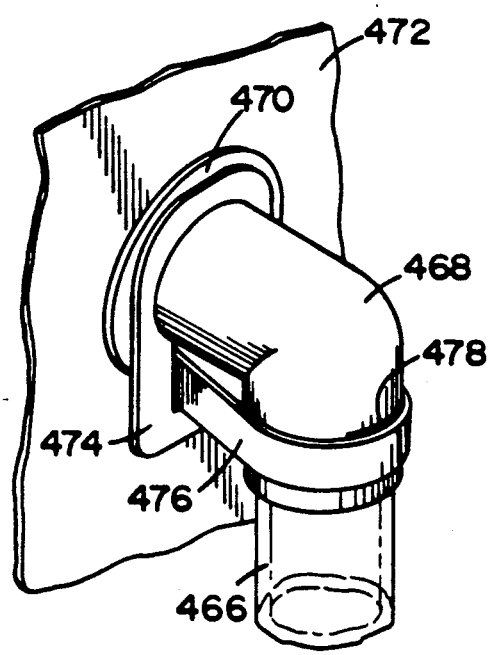

FIGS. 22(*a*) and (*b*) illustrate a preferred method of assuring that the air hoses remain attached to the air bags and cannot be accidentally disconnected. Since bed system 400 is designed to be portable, it is necessary that the ends of the hoses may be secured in any orientation in which they may happen to be connected to the air bags. Here, the end of a typical air hose 466 is attached to an elbow connector 468 sized to fit over a flanged nipple 470 attached to an air bag 472. A plate 474 rotatingly disposed on nipple 470 has attached thereto the ends of straps 476 and 478. After hose 466 is connected to air bag 472, straps 476 and 478 are placed over the hose and connected together by means of a buckle (not shown) or they may be Velcro material (as shown) and require no separate mechanical connecting mechanism. Thus, regardless of the orientation of hose 466 about nipple 470, plate 474 may be rotated so that straps 476 and 478 can be positioned to releasably hold hose 466 securely in place.

The embodiment being described includes having air hose connections to the sides of the air bags. Alternatively, within the intent of the present invention, air hose connections could be furnished on the bottoms of the air bags. The former arrangement is preferred, however, since it offers greater flexibility in the types of surfaces with which the bed system may be employed.

Figure 24:
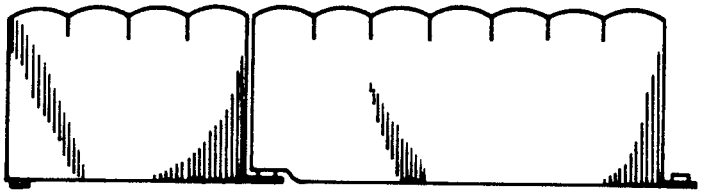
FIG. 24 is a side elevation view of an alternative mattress structure arrangement according to the present invention.
Figure 25:
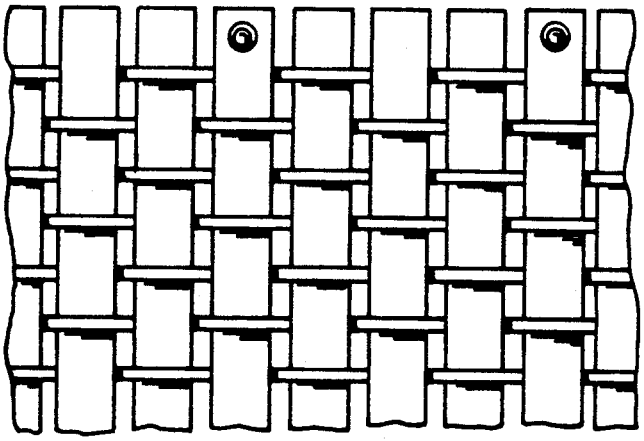
FIG. 25 is an alternative base pad structure according to the present invention.

An illustrated above, base pad 446 is a single piece of material and it has been found that a preferred material is ⅛-inch thick neoprene rubber, especially when mattress structure 402 is to be placed over springs; although, any suitable material may be employed, provided it has sufficient flexibility to be rolled or folded into a suitable shape for shipping. For example, other synthetic rubber materials, reinforced or not, fabric mats, or even slats interleaved with webbing, as illustrated on FIG. 25 may be employed. The bottom panels of the air bags may also serve as base pads, FIG. 24 illustrating how such air bags could be joined together by means of snaps, as shown, or by other mechanical means.

Figure 23:
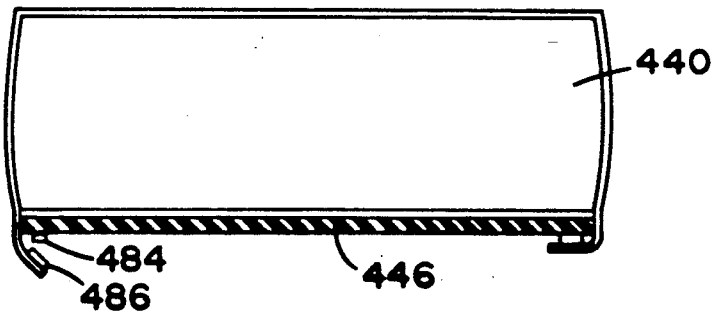
FIG. 23 is an end elevation view illustrating a means of attachment of an air bag to a base pad according to the present invention.

FIG. 23 illustrates how air bags 440–443 are preferably attached to base pad 446. Here, air bag 440 is shown as being attached to base pad 446 by means of a plurality of snap fittings, as at 484 and 486.

Figure 26:
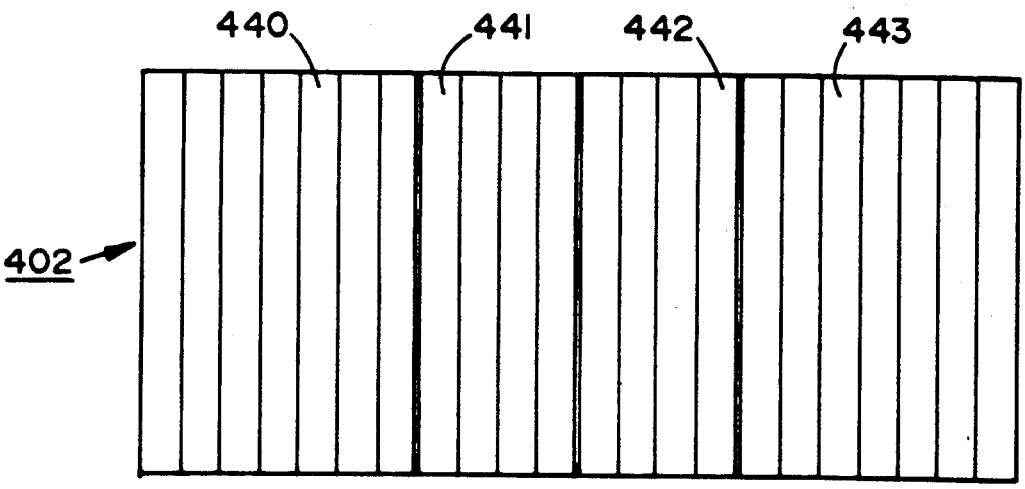
FIG. 26 is a top plan view of the air bags of the mattress structure of FIG. 17.

Bed structure 10 described above employed five air bags 112–116, each having four compartments. While that arrangement is quite satisfactory, it has been found that the arrangement of air bags 440–443 can improve patient comfort in some cases. FIG. 26 illustrates such an arrangement wherein it can be seen that each of air bags 440 and 443 has seven compartments, while each of air bags 441 and 442 has four compartments.

Figure 27:
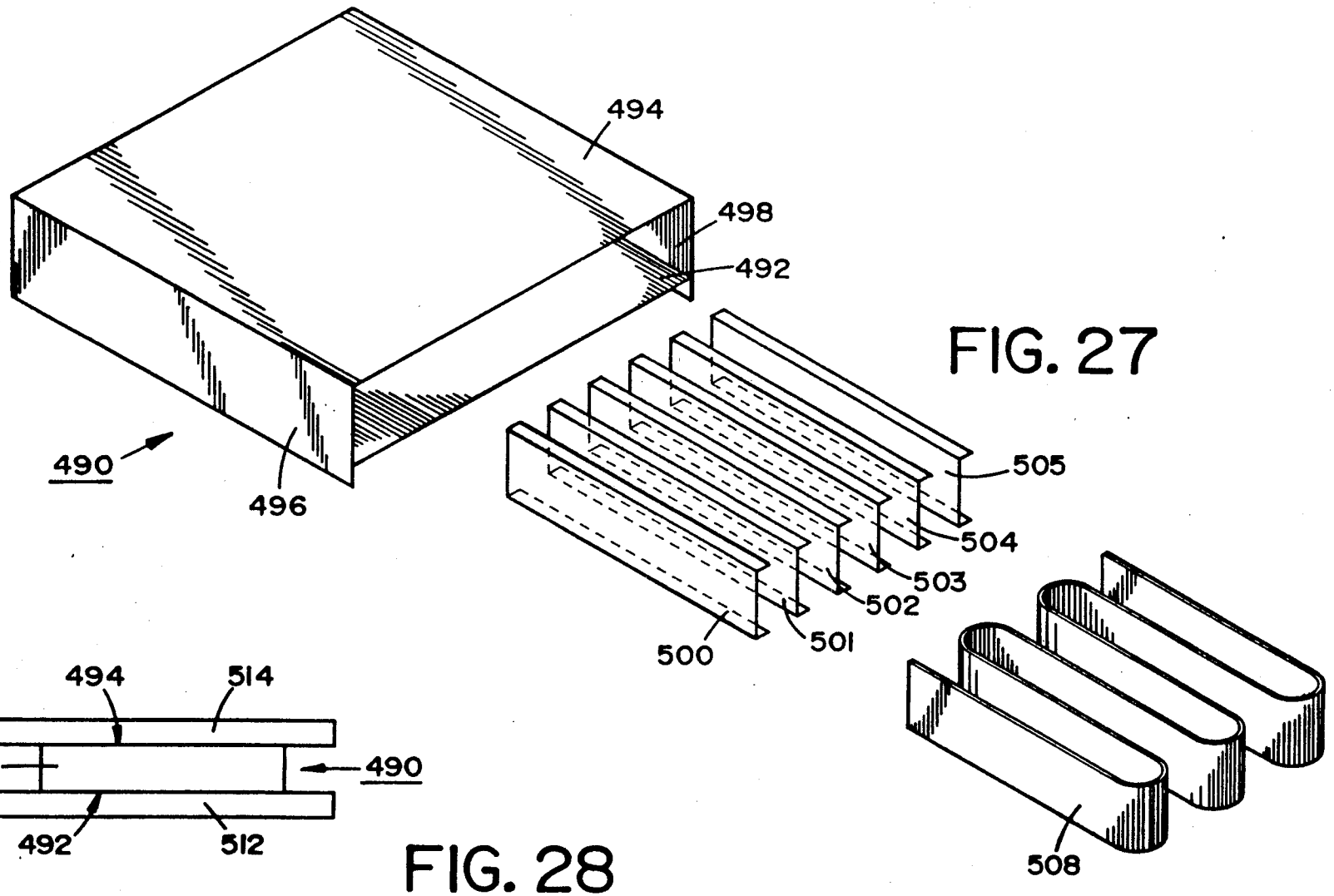
FIG. 27 is a perspective view illustrating the means of manufacture of air bags according to the present invention.
Figure 28:
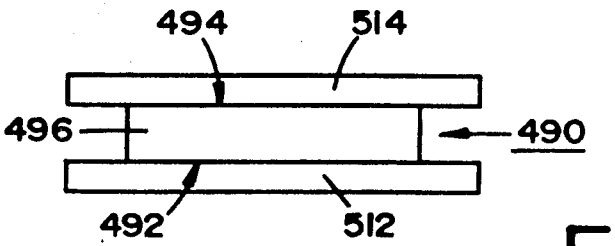
FIG. 28 is a side elevation view of the means of FIG. 27.

FIG. 27 illustrates the preferred method of fabricating an air bag. Here, there is first formed an open sleeve, generally indicated by the reference numeral 490, comprising bottom 492, top 494, and sides 496 and 498. Then, bulkheads 500–505 are positioned over fixture 508 and the fixture with the bulkheads thereon is inserted in sleeve 490. Referring now to FIG. 28, sleeve 490 is then placed on a base plate 512 and an RF platen is lowered to top 494 of the sleeve. RF energy heats fixture 508 and the upper and lower edges of bulkheads 500–505 are thereby welded to top 494 and bottom 492. Finally, the ends of the air bag are welded to either end of the sleeve to complete the fabrication. Such a method of fabrication provides a rapid and economical method of fabricating air bags or similar articles having internal bulkheads. Fixture 508 is preferably aluminum or brass.

It will thus be seen that the objects set for the above, among those made apparent from the preceding description and the accompanying drawing figures, are efficiently attained and, since certain changes may be made in the above construction without departing from the scope of the invention, it is intended that all matter contained in the above description or shown on the accompanying drawing figures shall be interpreted all illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A frameless bed structure, comprising:

(a) a horizontal, sheetmetal deck panel having first and second oppositely disposed end edges and two oppositely disposed side edges;

(b) vertical, sheetmetal side panels, each said side panel having first and second oppositely disposed ends and upper and lower edges, said side panels extending from said side edges of said deck panel to the surface upon which said bed structure rests;

(c) a headboard attached to said first end of said deck panel and to said first ends of said side panels;

(d) a footboard attached to said second end of said deck panel and to said second ends of said side panels; and (e) said members forming said frameless bed structure without requiring the use of structural members for support or attachment.

2. A bed structure, as defined in claim 1, further comprising:

(a) an inward facing flange formed at the lower end of each said side panel; and (b) casters fixed to each of said inward facing flanges.

3. A bed structure, as defined in claim 1, further comprising a bottom panel extending between said lower edges of said side panels.

4. A bed structure, as defined in claim 1, further comprising at least one bulkhead attached to an extending between the lower surface of said deck panel and the inner surfaces of said side panels.

5. A bed structure, as defined in claim 4, further comprising said bulkhead attached to the inner surface of said bottom panel.

6. A bed structure, as defined in claim 1, wherein:

(a) said deck panel comprises two sheets joined at a longitudinal seam extending between said first and seconds ends, said seam formed by the attachment of vertical downward-facing flanges formed on the inner edge of each of said sheets; and (b) each one of said side panels is integral with a one of said sheets.

7. A bed structure, as defined in claim 1, wherein said bed structure comprises an air bed.

8. A bed structure, as defined in claim 7, wherein said air bed comprises:

(a) at least one air bag removably disposed on said deck panel, said air bag having means to permit the escape of air from the surface thereof;

(b) air supply means to supply air to said at least one air bag;

(c) air inlet means to supply air to said air supply means.

9. A bed structure, as defined in claim 8, wherein said air bag comprises:

(a) generally rectilinearly joined top, bottom, end, and side panels; and (b) at least one solid bulkhead attached to the inside surfaces of said top and bottom panels and extending substantially completely thereacross transversely.

10. A bed structure, as defined as in claim 8, wherein said air supply means comprises:

(a) an inlet air filter;

(b) a blower having its inlet connected to draw air through said air filter;

(c) said blower having its outlet connected to air flow control means; and (d) said air flow control means connected to said at least one air bag.

11. A bed structure, as defined in claim 10, further comprising a silencer connected to the outlet of said blower.

12. A bed structure, as defined in claim 8, wherein:

(a) said air supply means is disposed at the foot of said bed structure in the cavity defined by said footboard, said two side panels, a bulkhead, and said bottom panel;

(b) said air inlet means is located in said bottom panel on the side of said bulkhead opposite of said cavity in which said air supply means is disposed; and (c) sufficient spaces are provided in said bulkhead to permit air to flow from said air inlet means to said air supply means, while said bulkhead reduces the level of noise that can escape from said air supply means through said air inlet means.

13. A bed structure, as defined in claim 10, wherein said flow control means comprises:

(a) a relatively flexible hollow tube having first and second ends;

(b) an inlet fitting connected to said first end of said hollow tube to permit air to flow into said hollow tube;

(c) an outlet fitting connected to said second end of said hollows tube to permit air to flow out of said hollow tube;

(d) a convex member engaging a point on the periphery of said hollow tube; and (e) means to advance said convex member against said hollow tube to constrict said hollow tube a selected degree, thereby to decrease the cross-sectional area of the inside of said tube at the plane of constriction and to control the rate of air flow through said hollow tube.

14. A bed structure, as defined in claim 1, further comprising at least one siderail rotatably attached to one of said side panels and rotatable in a plane parallel to the plane of said one of said side panels to which it is attached, said siderail comprising:

(a) a vertical member;

(b) gate means formed as an horizontal, unidirectional extension of said vertical member so as to serve as a barrier when said siderail is in its closed position; and (c) means disposed at the lower end of said vertical member to permit rotation of said siderail.

15. A bed structure, as defined in claim 14, wherein said siderail is rotatable 90 degrees between an open position and a closed position.

16. A bed structure, as defined in claim 15, wherein said siderail is adapted to be releasably selectively locked in either its open or its closed positions.

17. A bed structure, as defined in claim 14, wherein said means to permit rotation of said siderail comprises:

(a) a mounting boss fixedly attached to said one of said sides;

(b) an opening defined in the lower end of said vertical member sized to closely fit said mounting boss; and (c) means to rotatably hold said opening in engagement with said mounting boss thereby to support said vertical member thereon.

18. A bed structure, as defined in claim 17, wherein said means to permit rotation of said siderail further comprises spring means to impede the free rotation of said siderail while said siderail is being rotated.

19. A bed structure, as defined in claim 1, further comprising a portion of said deck panel being inclinable.

20. A siderail for a bed, said siderail to be attached to one side of said bed and being rotatable in a plane parallel to the plane of said one side to which it is attached, said siderail comprising:

(a) a vertical member;

(b) gate means formed solely as an horizontal, unidirectional extension of said vertical member so as to serve as a barrier when said siderail is in its closed position; and (c) rotation means disposed at the lower end of said vertical member to permit rotation of said siderail only 90 degrees such that said unidirectional extension extends vertically when said siderail is in its open position.

21. A siderail for a bed, as defined in claim 20, wherein said siderail is rotatable 90 degrees between an open position and a closed position.

22. A siderail for a bed, as defined in claim 21, wherein said siderail is adapted to be releasably selectively locked in either its open or its closed positions.

23. A siderail for a bed, as defined in claim 20, wherein said means to permit rotation of said siderail comprises:

(a) a mounting boss fixedly attached to said one of said sides;

(b) an opening defined in the lower end of said vertical member sized to closely fit said mounting boss; and (c) means to rotatably hold said opening in engagement with said mounting boss thereby to support said vertical member thereon.

24. A siderail for a bed, as defined in claim 23, wherein said means to permit rotation of said siderail further comprises spring means to impede the free rotation of said siderail while said siderail is being rotated.

25. A flow control valve, comprising:

(a) a relatively flexible hollow tube having first and second ends;

(b) an inlet fitting connected to said first end of said hollow tube to permit air to flow into said hollow tube;

(c) an outlet fitting connected to said second end of said hollow tube to permit air to flow out of said hollow tube;

(d) a convex, generally cylindrical member engaging a point on the periphery of said hollow tube, said cylindrical member having a major axis parallel to the major axis of said tube; and (e) a generally circular yoke lying in a plane orthogonal to the major axis of said hollow tube, surrounding said hollow tube and engaging a portion thereof opposite said point engaged by said convex member and adapted to be advanced toward said convex member to constrict therebetween said hollow tube a selected degree, thereby to decrease the cross-sectional area of the inside of said tube at the plane of constriction and to control the rate of air flow through said hollow tube.

26. A portable air bed system, comprising:

(a) a flexible base pad capable of being rolled into a relatively small diameter cylinder;

(b) at least one air bag attached directly to said base pad, said at least one air bag comprising: (i) generally rectilinearly joined top, bottom, end, and side panels; and (ii) at least one transverse bulkhead attached only to the inside surfaces of said top and bottom panels and extending substantially completely thereacross; and (c) air supply means to supply compressed air to said air bag.

27. A portable air bed system, as defined in claim 26, further comprising at least one air hose to convey said compressed air from said air supply means to said at least one air bag.

28. A portable air bed system, as defined in claim 27, further including means to releasably attach said one at least one air hose to said at least one air bag in any orientation of said air hose with respect to said at least one air bag.

29. A portable air bed system, as defined in claim 26, wherein, when said system is in a portable configuration, said system has dimension and weight parameters no greater than (girth+length=) 130 inches and 70 pounds, respectively.

30. A portable air bed system, as defined in claim 26, wherein said base pad is adapted to be removably attached to a bed frame.

31. A portable air bed system, as defined in claim 30, wherein said base pad is adapted to be removably attached to a bed frame by means of straps.

32. A portable air bed system, as defined in claim 31, further including a mattress cover which is adapted to be attached to said straps.

33. A portable air bed system, as defined in claim 26, further including a mattress cover which is adapted to be attached to a bed frame.

34. A portable air bed system, as defined in claim 26, wherein said base pad is formed of neoprene rubber.

35. A portable air bed system, as defined in claim 26, wherein said at least one air bag is attached to said base pad by means of snaps.

36. A portable air bed system, as defined in claim 26, wherein said base pad comprises a plurality of sections.

37. A portable air bed system, as defined in claim 26, wherein said base pad is integral with said at least one air bag.

38. A portable air bed system, as defined in claim 26, wherein said at least one air bag comprises:

(a) generally rectilinearly joined top, bottom, end, and side panels; and (b) at least one solid bulkhead attached to the inside surfaces of said top and bottom panels and extending substantially completely thereacross transversely.

39. A portable air bed system, as defined in claim 26, wherein, when said system is in a portable configuration, said system has dimension and weight parameters no greater than (girth+width=) 100 inches and 70 pounds, respectively.

* * * * *